US005225313A

United States Patent [19]

Aono et al.

[11] Patent Number: 5,225,313

[45] Date of Patent: Jul. 6, 1993

[54] DYE FIXING ELEMENTS

[75] Inventors: Toshiaki Aono; Takeshi Shibata; Kazuma Takeno, all of Kanagawa, Japan

[73] Assignee: Fuji Photo Film Co., Ltd., Kanagawa, Japan

[21] Appl. No.: 804,525

[22] Filed: Dec. 9, 1991

Related U.S. Application Data

[63] Continuation of Ser. No. 310,552, Feb. 15, 1989, abandoned.

[30] Foreign Application Priority Data

Feb. 15, 1988 [JP] Japan ..... 63-32423

[51] Int. Cl.[5] ..... G03C 5/54; G03C 11/06

[52] U.S. Cl. ..... 430/213; 430/203; 430/215; 430/220; 430/950

[58] Field of Search ..... 430/203, 213, 215, 220, 430/950

[56] References Cited

U.S. PATENT DOCUMENTS

| | | | |
|---|---|---|---|
| 3,811,924 | 5/1974 | Gallagher et al. | 430/950 |
| 4,357,418 | 11/1982 | Cellone | 430/950 |
| 4,367,284 | 1/1983 | Cellone et al. | 430/539 |
| 4,636,455 | 1/1987 | Aono et al. | 430/213 |
| 4,783,392 | 11/1988 | Aono et al. | 430/213 |
| 5,053,312 | 10/1991 | Takeda | 430/254 |

*Primary Examiner*—Richard L. Schilling
*Attorney, Agent, or Firm*—Sughrue, Mion, Zinn, Macpeak & Seas

[57] ABSTRACT

A dye fixing element is disclosed, comprising a support having provided thereon a dye fixing layer which mordants a diffusible dye, wherein at least one of said dye fixing layer or a layer adjacent thereto contains two or more kinds of high molecular weight binders which exhibit phase separation each other so as to give a mat appearance.

23 Claims, 1 Drawing Sheet

DYE FIXING ELEMENTS

This is a continuation of application Ser. No. 07/310,552, filed Feb. 15, 1989, now abandoned.

FIELD OF THE INVENTION

This invention relates to a dye fixing element and, more particularly, to a dye fixing element with a mat surface, which has improved smoothness at the surface, shows little decrease in the maximum density, and prevents uneven transfer from occurring at the time of dye-image transfer.

BACKGROUND OF THE INVENTION

In the conventional color diffusion transfer process and heat development transfer process, diffusible dyes formed or released imagewise through development of a light-sensitive element after exposure are diffused and transferred into a dye fixing layer containing a mordant or a dye-accepting polymer. Dye images are observed after the dyes have been transferred and fixed in the dye fixing layer.

The appearance of the surface, be it glossy or mat one, is selected depending on the end-use purpose of the dye fixing element, the user's preference, and so on.

Though addition of a matting agent has so far been known as one of the matting methods, the most inexpensive and effective method is such that unevenness is given to the support surface through embossment processing performed in the course of the production of the support. Therein, however, a dye fixing layer with a smooth surface is not obtained, because when a dye fixing layer constituted by a mordant and a binder is provided on a support whose surface has been rendered uneven by the embossment processing, the dye fixing layer surface opposite to the interface between the support and the dye fixing layer also becomes uneven corresponding approximately to the unevenness of the support surface. The case wherein the dye fixing element poor in surface smoothness is superimposed on a light-sensitive element, and diffusible dyes produced in the light-sensitive element are transferred into the dye fixing element to form the dye images, causes a problem of generating transfer marks (or such uneven density as to have white spots in colored areas corresponding to concaved spots).

In the heat development transfer process in particular, a preferably used method involves containing in the image forming reaction system as a base precursor a combination of a basic metal compound slightly soluble in water and a compound capable of undergoing in water as a medium the complexing reaction with the metal ion constituting said slightly soluble metal compound (which is abbreviated as "complexing compound", hereinafter), and raising the pH of the reaction system by allowing these two compounds to react with each other upon heating. (In order to prevent these slightly soluble metal compound and complexing compound from reacting with each other prior to development-processing, it is desirable that the slightly soluble metal compound should be incorporated in, e.g., a light-sensitive element, and the complexing compound in, e.g., a dye fixing element having a support other than that of the light-sensitive element.) However, when the dye fixing element poor in surface smoothness is superimposed upon the light-sensitive element, an increase in pH through the reaction between the foregoing compounds occurs in the convex part, but little occurs in the concave part. Thereby, an ununiform distribution of an alkali concentration is caused at the interface between both elements to result in a serious problem of considerable generation of dye-image transfer marks.

On the other hand, the method of forming a mat surface by addition of matting agent particles causes transfer marks similar to those described above when the particle size of the matting agent is relatively large, compared with the thickness of the dye fixing layer, whereas when the particle size is relatively small the method cannot achieve a sufficient matting effect. Moreover, the method of using a matting agent in the outermost layer generally causes a sharp drop of the maximum image density.

Accordingly, even in these methods of adding a matting agent, dye fixing elements with a uniform mat surface, which exhibit high image density and no transfer mark, have not been obtained yet.

SUMMARY OF THE INVENTION

Therefore, an object of this invention is to provide a dye fixing element which is excellent in surface smoothness, causes only a slight decrease of image density even though matted, and has a mat surface which does not suffer from generation of transfer marks upon transfer of dye images.

That is, this invention relates to a dye fixing element comprising a support having provided thereon a dye fixing layer which mordants a diffusible dye, wherein at least one of said dye fixing layer or a layer adjacent thereto contains two or more kinds of high molecular weight binders which exhibit phase separation each other so as to give a mat appearance.

DETAILED DESCRIPTION OF THE INVENTION

Figure 1A:
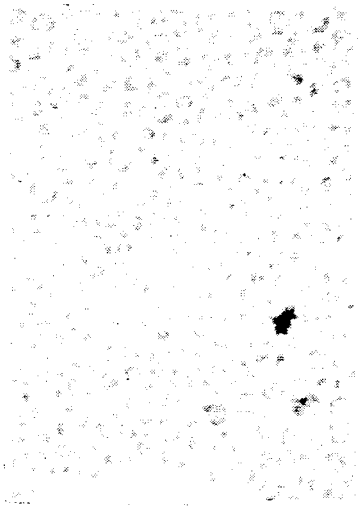
FIGS. 1(*a*) and (*b*) are photomicrographs (magnification: 750) of crystals which are generated through microphase separation in films formed by combinations of polymers of this invention, in which (a) is the photomicrograph of the film of a 1:1 mixture of sodium polymethacrylate and gum arabic, and (b) is that of a 1:1 mixture of sodium polymethacrylate and sodium polyacrylate.

In a first embodiment of this invention, a dye fixing element capable of accepting diffusible dyes and fixing them therein, which comprises at least one constituent layer containing a combination of at least two water-soluble high molecular weight binders (i.e., polymers) of such kinds that they are in a substantial sense in a single phase condition when they are present in a coating solution containing all ingredients to constitute said layer, but undergo microphase separation during the period from the coating of the coating solution to the completion of the drying of the coated layer.

In accordance with this embodiment, a matted surface of even quality comes to be obtained, irrespective of aging of the coating solution and preparation conditions thereof including a stirring condition.

The expression "to be in a substantial sense in a single phase condition" as used in connection with the coating solution of this invention means that the coating solution does not tend to separate into two phases while standing at the temperature of its preparation and coating (in general, ranging from room temperature to 50° C.).

As for the combination of high molecular weight binders which exhibit microphase separation in the coated layer during the drying thereof, any combination which can be made to exhibit microphase separation during the drying step or a change in temperature when two or more kinds of aqueous solutions of high molecular weight binders (ranging in concentration from 1 to 50 wt %, and having a viscosity of 1,000 cps or less, particularly 200 cps or less at 25° C.) are mixed, in amounts of the same weight on a solids basis, coated on a microscope slide glass, and then dried at a temperature of −10° C. to 70° C., and that have such a microphase separation structure as to be observed with an optical microscope (especially an islet structure) can be used in this invention. The coat on the slide glass looks turbid so long as the microphase separation is exhibited therein.

An aqueous solution of the combination of certain high molecular weight binders to cause microphase separation in the coated layer during the drying, which characterizes this invention, does not exhibit phase separation when the binders are in a low concentration in the coating solution, but the phase separation begins just as the aqueous solution is being concentrated through evaporation of water in the drying step. The concentration of which phase separation begins depends upon the kinds of high molecular binders combined. In this invention, it is necessary to lower the high molecular binder concentration in the coating solution at least to the point where phase separation is not caused therein in a substantial sense prior to coating.

In combinations of certain high molecular compounds, the conversion of the single phase condition to the phase-separated condition is sensitive to temperature. In such a case, it becomes feasible that the preparation, the transport and the coating of the coating solution are carried out within the temperature range at which the coating solution can be maintained in the single phase condition, and the subsequent gelation or/and drying steps are carried out within the temperature range at which microphase separation takes place.

For instance, in the case where the phase separation, though isn't caused at about 40° C., is brought about by lowering the temperature to about 0° to 10° C., the preparation, the transport and the coating steps may be carried out at 40° C., and then the coated layer is rapidly cooled to 0° to 10° C. to bring about the microphase separation as it is in a wet condition. The resulting layer is dried to "fix" the state of microphase separation. Therein, after the drying is continued in the foregoing low temperature range till the phase separation structure is secured, it may be completed at high temperatures. In contrast to the above case, when the phase separation takes place at high temperatures (e.g., 60° C. or above), the preparation and the coating steps may be carried out at from room temperature to 40° C., and the drying at a temperature of 60° C. or above is enough to accomplish the phase separation.

Suitable examples of the combinations of hydrophilic polymers to be used in this invention, which, though present in the single phase condition when contained in coating solutions, undergo the microphase separation during the process of drying the wet layer of the coating solution, include those shown in Table 1. More specifically describing such combinations, when the polymers set forth in the columns A and B, respectively, are mixed in the form of a 0.5 to 5 wt % aqueous solution and allowed to stand over one day and night at 40° C., the resulting mixture is not separated into two phases and is present in a nearly transparent condition. This mixture is coated on slide glass in a wet thickness of 10 to 50 microns and then dried at room temperature to result in generation of milky turbidity.

According to examination of the thus obtained dry coat with an optical microscope, microphase separation with an islet structure is observed.

Though only the combinations of two kinds of hydrophilic polymers are set forth in Table 1, combinations of three or more kinds of hydrophilic polymers may be employed, provided that, in analogy with the foregoing combinations, they generate milky turbidity through microphase separation while the wet coated layer is being dried.

In addition, the hydrophilic polymer combinations which are particularly preferred with respect to the quality of the mat surface are marked with a circle in the column C of Table 1.

Moreover, it is to be desired that at least one of the two or more kinds of hydrophilic polymers to be mixed should be a polymer having a low polymerization degree and a viscosity of 200 cps or less, preferably 100 cps or less, and more preferably 50 cps or less at 25° C., in the form of a 5% aqueous solution. This is because the phase separation in the wet coated layer is thought to occur more readily when at least one hydrophilic polymer has low viscosity.

As for the mixing ratio of two or more kinds of hydrophilic polymers to cause the microphase separation in the wet coated layer of this invention, it may be any values so long as the solution containing them becomes turbid when coated on slide glass. Specifically, when two kinds of hydrophilic polymers A and B are mixed, A:B may range from 10:90 to 90:10 and preferably from 25:75 to 75:25 by weight. When three or more kinds of hydrophilic polymers are mixed, a weight ratio between two phases formed by the microphase separation ranges from 10:90 to 90:10, preferably from 25:75 to 75:25. Even when three or more phases are formed by microphase separation, the weight ratio between the two main phases should range from 10:90 to 90:10, preferably from 25:75 to 75:25.

Figure 1B:
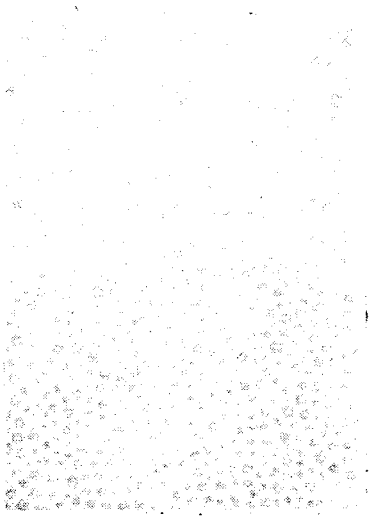

FIGS. 1 (*a*) and (*b*) show photomicrographs of the films formed by coating on separate slide glasses a 1:1 mixture of 5% aqueous solutions of sodium polymethacrylate and gum arabic (FIG. 1 (*a*)) and a 1:1 mixture of 5% aqueous solution of sodium polymethacrylate and sodium polyacrylate (FIG. 1 (*b*)) in a wet thickness of 10 to 40 microns, respectively and then drying each of the coats. The magnification of the optical microscope used is 750. These photographs reveal clearly microphase-separated conditions.

TABLE 1

| Combination No. | A | B | C |
|---|---|---|---|
| 1 | Gelatin | Hydroxyethyl cellulose | ○ |
| 2 | Phthalized gelatin (Phthalization degree: 98%) | Polyacrylate (Na salt, $NH_4$ salt, etc.) | |

TABLE 1-continued

| Combination No. | A | B | C |
|---|---|---|---|
| 3 | Phthalized gelatin (Phthalization degree: 98%) | Polymethacrylate (Na salt, $NH_4$ salt, etc.) | |
| 4 | Phthalized gelatin (Phthalization degree: 98%) | Block polymer of vinyl alcohol and acrylic acid | ○ |
| 5 | Phthalized gelatin (Phthalization degree: 98%) | Polyethylene glycol (molecular weight: 20,000) | |
| 6 | Phthalized gelatin (Phthalization degree: 98%) | Polyacrylamide Polyacrylamide | ○ |
| 7 | Phthalized gelatin (Phthalization degree: 98%) | Gum arabic | ○ |
| 8 | Phthalized gelatin (Phthalization degree: 98%) | Carboxymethyl cellulose | |
| 9 | Sodium or ammonium polyacrylate | Polymethacrylte (Na salt, $NH_4$ salt, etc.) | ○ |
| 10 | Sodium polyacrylate | Block polymer of vinyl alcohol and acrylic acid | |
| 11 | " | Polyethylene glycol (molecular weight: 20,000) | |
| 12 | Sodium polyacrylate | Polyacrylamide | |
| 13 | " | Pullulan | |
| 14 | " | Gum arabic | |
| 15 | " | Sodium alginate | |
| 16 | " | Poly(potassium vinylbenzenesulfonate) | |
| 17 | " | $\leftarrow CH_2-CH\rightarrow_{99}\leftarrow CH_2-CH\rightarrow_{1}$ (CH3 branch, CONH2, CONH, C, CH2SO3Na, CH3) | |
| 18 | " | Carboxymethyl cellulose | |
| 19 | Sodium polymethylacrlate | Hydroxymethyl cellulose | ○ |
| 20 | " | Copolymer of vinyl alcohol and acrylic acid | ○ |
| 21 | " | Polyvinyl alcohol | ○ |
| 22 | " | Polyethylene glycol (molecular weight: 20,000) | |
| 23 | " | Polyacrylamide | ○ |
| 24 | Sodium polymethylacrylate | Pullulan | |
| 25 | " | Gum arabic | ○ |
| 26 | " | Poly(potassium vinylbenzenesulfonate) | ○ |
| 27 | " | $\leftarrow CH_2-CH\rightarrow_{99}\leftarrow CH_2-CH\rightarrow_{1}$ (CH3 branch, CONH2, CONH, C, CH2SO3Na, CH3) | |
| 28 | " | Carboxymethyl cellulose | ○ |
| 29 | Block polymer of vinyl alcohol and acrylic acid | Dextran | |
| 30 | Block polymer of vinyl alcohol and acrylic acid | Hydroxymethyl cellulose | |
| 31 | Hydroxyethyl cellulose | Polyvinyl alcohol | |
| 32 | " | Polyethylene glycol (molecular weight: 20,000) | ○ |
| 33 | Hydroxylethyl cellulose | Polyacrylamide | |
| 34 | " | Pullalan | ○ |
| 35 | " | Dextran | ○ |
| 36 | " | Gum arabic | ○ |
| 37 | Polyethylene glycol (molecular weight: 20,000) | Polyacrylamide | |
| 38 | Polyethylene glycol (molecular weight: 20,000) | Polyvinylpyrrolidone | |
| 39 | Polyethylene glycol (molecular weight: 20,000) | Dextran | |
| 40 | Polyethylene glycol (molecular weight: 20,000) | Gum arabic | ○ |
| 41 | Polyethylene glycol (molecular weight: 20,000) | sodium alginate | |
| 42 | Polyethylene glycol (molecular weight: 20,000) | Poly(potassium vinylbenzenesulfonate) | |
| 43 | Polyvinyl alcohol (molecular weight: 20,000) | Polyethylene glycol (molecular weight: 20,000) | |
| 44 | " (molecular weight: 20,000) | Polyacrylamide | |

TABLE 1-continued

| Combination No. | A | B | C |
|---|---|---|---|
| 45 | Polyvinylpyrrolidone | Pullulan | |
| 46 | " | Dextran | |
| 47 | Polyvinylpyrrolidone | Carboxymethyl cellulose | |
| 48 | Sodium alginate | Carboxymethyl cellulose | ○ |
| 49 | " | $\leftarrow CH_2-CH\rightarrow_{99}$ $\leftarrow CH_2-CH\rightarrow_{1}$ (CONH–C(CH3)2–CH2SO3Na; CONH2) | |
| 50 | Poly(potassium vinyl-benzenesulfonate) | " | ○ |
| 51 | Methyl cellulose | Hydroxyethyl cellulose | |
| 52 | " | Polyvinyl alcohol | |
| 53 | " | Polyethylene glycol (molecular weight: 20,000) | |
| 54 | " | Polyacrylamide | |
| 55 | " | Pullulan | |
| 56 | " | Gum arabic | |
| 57 | " | Dextran | |
| 58 | Methyl cellulose | Sodium alginate | |
| 59 | " | Poly(potassium vinylbenzene-sulfonate) | |
| 60 | " | $\leftarrow CH_2-CH\rightarrow_{99}$ $\leftarrow CH_2-CH\rightarrow_{1}$ (CONH–C(CH3)2–CH2SO3Na; CONH2) | |
| 61 | Poly(potassium vinyl-benzenesulfonate) | Carboxymethyl cellulose | ○ |
| 62 | Methyl cellulose | Carboxymethyl cellulose | |
| 63 | Polyethylene glycol (molecular weight: 20,000) | " | |
| 64 | Polyethylene oxide (molecular weight: 300,000) | Polyvinyl alcohol | ○ |
| 65 | Carboxymethyl cellulose | " | ○ |

The combination of water-soluble polymers to cause microphase separation in the coated layer may be incorporated in a dye fixing layer, a layer located on the upper or the lower side thereof, or a plurality of layers including them. However, it is to be desired that the combination of two or more layers should include the outermost layer.

Two or more kinds of water-soluble polymers to cause microphase separation may be coated at any total coverage in this invention. However, a preferred total coverage thereof is generally from 0.01 to 10g/m$^2$, particularly from 0.1 to 5 g/m$^2$ based on polymer.

A size of the phases forming individual islets upon microphase separation in the coated layer comprising water-soluble polymers, which can impart a mat quality to the fixed dye images, is generally from 0.2 to 100 microns, preferably from 0.5 to 50 microns, and more preferably from 1 to 30 microns.

In another embodiment of this invention, as for the combination of high molecular weight binders which exhibit microphase separation, those which exhibit phase separation into two or more phases when two or more kinds of aqueous solutions of high molecular weight binders (in a concentration of from 0.5 to 10 wt %) are mixed and stirred in the same amounts at a temperature of from 20° to 40° C., charged in a cylinder and then allowed to stand at that temperature can be used. That is, combinations of high molecular weight binders which already exhibit microphase separation in the state of coating solution can also be used. Examples of such combinations include combinations of polyvinyl alcohol/gelatin, polyvinyl alcohol/polyacrylic acid, and polyvinyl alcohol/polyacrylamide, with a combination of polyvinyl alcohol/gelatin being preferred.

The proportion (weight ratio) of two or more high molecular weight binders which exhibit microphase separation in the state of coating solution varies depending on the kind of the high molecular weight binders but is preferably from 10/90 to 90/10 and more preferably 20/80 to 60/40 on a weight basis in the case of the combination of polyvinyl alcohol/gelatin.

Preferred ranges of the coating amount and size of the phase of microphase separation are the same as in the foregoing first embodiment.

In the dye fixing layer of this invention, a mordant is preferably used. The mordant can be arbitrarily chosen from conventionally used ones.

Polymeric mordants can also be used in this invention. Suitable examples thereof include polymers containing tertiary amino groups, and polymers having nitrogen-containing heterocyclic moieties, polymers containing quaternary cationic groups.

Preferred examples of homo- and co-polymers comprising a tertiary amino group-containing vinyl monomer unit are illustrated below. The numeral affixed to each monomer unit represents mol %.

(1)

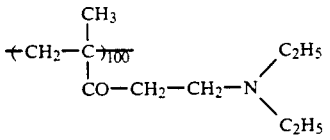

(2)

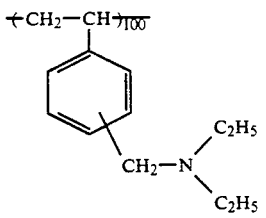

(3)

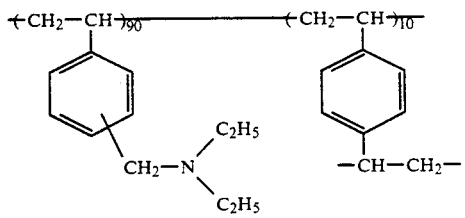

As specific examples of homo- and co-polymers comprising a tertiary imidazolyl group-containing vinyl monomer unit, mention may be made of the mordants described in, e.g., U.S. Pat. Nos. 4,282,305, 4,115,124 and 3,148,061, JP-A-60-118834 (the term "JP-A" as used herein means an "unexamined published Japanese patent application"), and JP-A-60-122941 and those illustrated below.

(4)

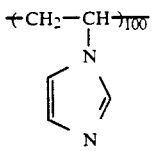

(5)

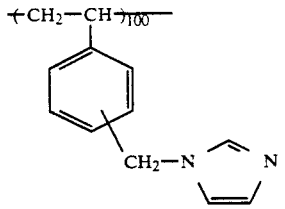

-continued (6)

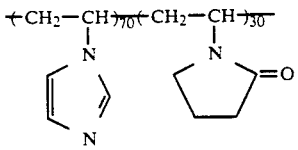

(7)

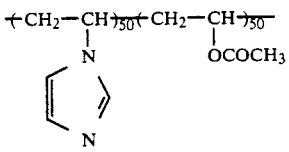

(8)

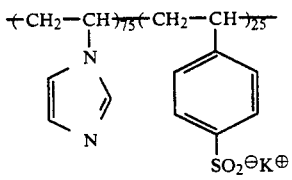

(9)

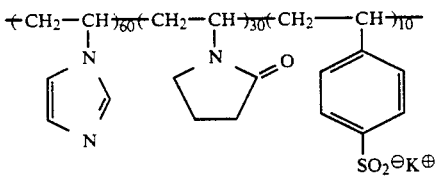

(10)

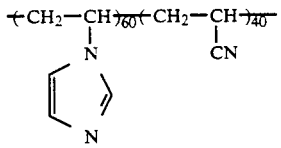

(11)

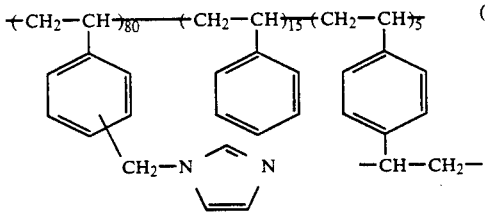

As specific examples of homo- and co-polymers comprising a quaternary imidazolium salt-containing vinyl monomer unit, mention may be made of the mordants described in, e.g., British Patents 2,056,101, 2,093,041 and 1,594,961, U.S. Pat. Nos. 4,124,386, 4,115,124, 4,273,853 and 4,450,224, and JP-A-48-28225 and those illustrated below.

(12)

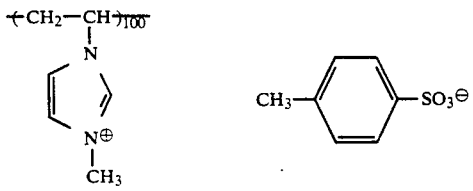

-continued
(13)
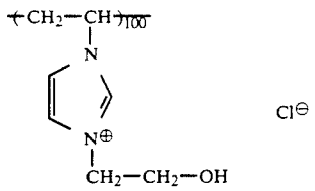
(14)
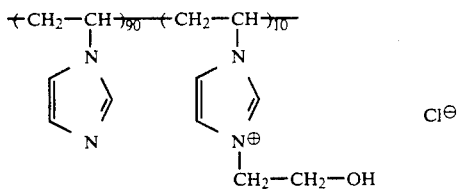
(15)
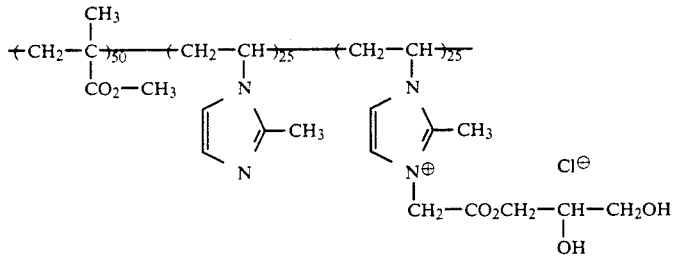
(16)
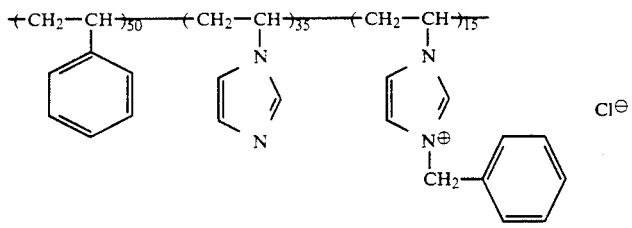
As specific examples of homo- and co-polymers comprising a quaternary imidazolium salt-containing vinyl monomer units, mention may be made of the mordants described in, e.g., U.S. Pat. Nos. 3,709,690, 3,898,088 and 3,958,995, JP-A-60-57836, JP-A-60-60643, JP-A-60-122940, JP-A-60-122942, and JP-A-60-235134 and those illustrated below.
(17)
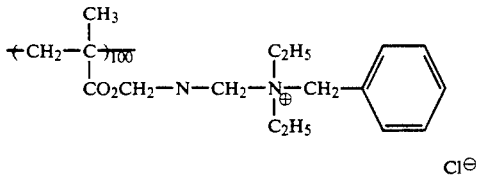
(18)
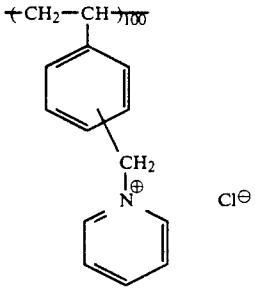
-continued
(19)
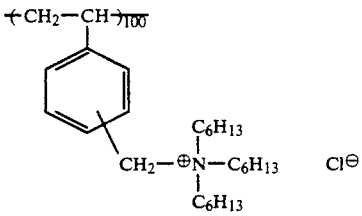
(20)
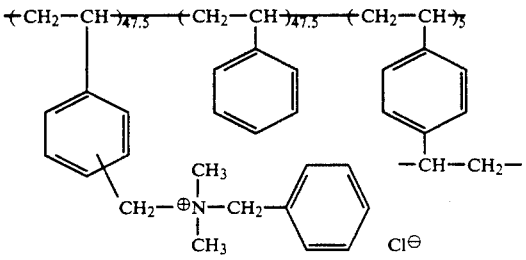

-continued (21)

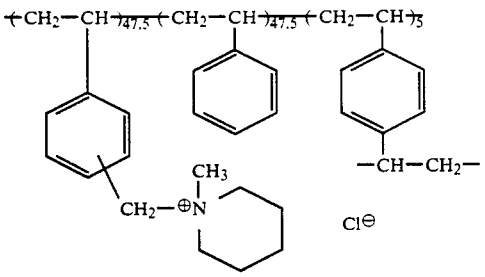

(22)

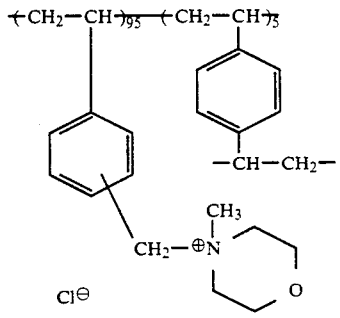

As other suitable examples, mention may be made of vinylpyridine polymers and vinyl pyridinium cationic polymers as disclosed in U.S. Pat. Nos. 2,548,564, 2,484,430, 3,148,161 and 3,756,814; cross-linkable polymeric mordants, such as gelatin, as disclosed in U.S. Pat. Nos. 3,625,694, 3,859,096 and 4,128,538 and British Patent 1,277,453; aqueous sol type mordants as disclosed in U.S. Pat. Nos. 3,958,995, 2,721,852 and 2,798,063, JP-A-54-115228, JP-A-54-145529, and JP-A-54-26027; water-insoluble mordants as disclosed in U.S. Pat. No. 3,898,088; reactive mordants capable of forming covalent bonds together with dyes, as disclosed in U.S. Pat. No. 4,168,976 (JP-A-54-137333); and mordants disclosed in U.S. Pat. Nos. 3,709,690, 3,788,855, 3,642,482, 3,488,706, 3,557,066, 3,271,147 and 3,271,148, JP-A-50-71332, JP-A-53-30328, JP-A-52-155528, JP-A-53-125, and JP-A-53-1024.

In addition, the mordants disclosed in U.S. Pat. Nos. 2,675,316 and 2,882,156 can be employed in this invention.

Of the above-cited mordants, those containing imidazolyl groups as the mordanting site (e.g., Compounds (4) to (11)) are preferred over others. In particular, Compounds (4), (6), (8) and (9) are used to advantage.

Molecular weights of polymeric mordants usable in this invention properly range from 1,000 to 1,000,000, particularly from 10,000 to 200,000.

The dye fixing layer of this invention is constituted by at least one layer, and may contain a brittleness modifier and a base or a base precursor in addition to a mordant and two or more kinds of high molecular binder materials to bring about the microphase separation.

Further, the dye fixing layer may optionally contain other additives, such as a hardener, a coating aid, a surfactant for prevention of electrification and adhesion, an antifoggant, a discoloration inhibitor, an ultraviolet absorbent, a slipping agent, hydrophilic polymers for the purpose of preventing a base or a base precursor from separating out, and a brightening agent.

Furthermore, it is desirable for obviating the brittleness of the dye fixing layer that oil droplets should be incorporated in a constituent layer located on the same side as the dye fixing layer (including a mordanting layer). Therein, a preferred amount of oil droplets added corresponds to 2 to 100 vol %, particularly 5 to 50 vol %, based on the volume of whole polymer in the constituent layer to which they are added.

The term "oil droplets" as used herein describes the independent oily system dispersed finely in a hydrophilic colloid, or liquid particles insoluble in water in a substantial sense. The oil droplet-addition effect becomes greater the finer the oil droplets are. Specifically, an average size thereof is preferably 3 microns or less, more preferably 1 micron or less, particularly 0.5 micron or less.

Materials to constitute the oil droplets used preferably in this invention are high boiling organic solvents, which are liquid at ordinary temperatures and do not evaporate at heating temperatures, with specific examples including esters (such as phthalates, phosphates, fatty acid esters), amides (such as fatty acid amides, sulfonamides), ethers, alcohols and paraffins, which are described in U.S. Pat. Nos. 2,322,027, 2,533,514 and 2,882,157, JP-B-46-23233 (the term "JP-B" as used herein means an "examined Japanese patent publication"), British Patents 958,441 and 1,222,753, JP-A-50-82078, U.S. Pat. Nos. 2,353,262, 3,676,142 and 3,600,454, JP-A-51-28921, JP-A-51-141623, and JP-A-62-9348. Of these materials, phosphates and paraffins are preferred over others.

Also, materials which, though solid individually, become liquid droplets in the coated layer through depression of their melting point when used in combination of two or more are included in the foregoing oil droplets.

In addition, materials which, though solid at ordinary temperature, can be present in the form of liquid droplet when incorporated into a hydrophilic binder or contained together with various photographic additives are included in the foregoing oil droplets.

As specific examples of these materials, mention may be made of stilbene, triazine, oxazole and coumarin type compounds used as brightening agent, and benzotriazole, thiazoline and cinnamate type compounds used as ultraviolet absorbent.

Specific examples of the oil droplets appropriate to be used in this invention are the compounds disclosed in JP-A-62-245253.

In a hydrophilic colloid layer provided on the dye fixing layer side in the dye fixing element of this invention, it is advantageous to incorporate a base or a base-releasing agent. When the light-sensitive element contains a slightly soluble metal compound, as described in particular hereinafter, it is desirable that a compound capable of complexing with the metal ion constituting the slightly soluble metal compound by utilizing water as a medium (a complexing compound) should be incorporated in the dye fixing element. A base or a base-releasing agent, e.g., a complexing compound, tends to separate out when contained in the coated layer in the form of salt. In order to prevent such a separation phenomenon, it is desirable to use polymers disclosed in JP-A-62-47639, such as dextran, pullulan, etc., or compounds containing polyalkylene oxide moieties, as disclosed in JP-A-62-65038. A preferred coverage of such compounds is 0.01 to 5 g/m$^2$.

The dye fixing layer containing a mordant can contain various kinds of surfactants for the purpose of enhancing the coating facility.

Further, a hardener can be used together in the dye fixing layer of this invention, preferably in an adjacent layer thereto.

Specific examples of a hardener which can be used in this invention include aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds [e.g., 1,3,5-triacryloyl-hexahydro-s-triazine, bis(vinylsulfonyl) methyl ether, N,N'-ethylene-bis(-vinylsulfonylacetamide), N,N'-trimethylene-bis-(vinylsulfonylacetamide)], active halogen-containing compounds (e.g., 2,4-dichloro-6-hydroxy-s-triazine), mucohalogenic acids (e.g., mucochloric acid, mucophenoxychloric acid), epoxy compounds, isooxaoles, dialdehyde starch, and 1-chloro-6-hydroxytriazinylated gelatin. More specifically, these hardeners are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,490,911, 3,539,644 and 3,543,292, British Patents 676,628, 825,544 and 1,270,578, German Patents 872,153, 1,090,427 and 2,749,260, JP-B-34-7133, and JP B-46-1872.

Of the hardeners cited above, aldehydes, active vinyl compounds, and active halogen-containing compounds as well as epoxy compounds disclosed in JP A-62-91942 are particularly preferred over others.

These hardeners, though they may be directly added to a coating solution for the mordanting layer, may be added to another coating solution and made to diffuse into the mordanting layer in the process of coating layers one over another.

An amount of the gelatin hardener to be used in this invention can be arbitrarily chosen depending upon the purpose. It is generally adequate to use the hardener in a proportion of about 0.1 to about 50 wt %, preferably 1 to 30 wt %, to gelatin used.

Mordants can heighten the densities of the transferred dyes particularly when used together with metal ions in the dye fixing element of this invention. The metal ions can be added to the mordanting layer containing a mordant, or a neighboring layer thereof (which may be located on the side near to the support carrying the mordanting layer, or on the side farthest therefrom). It is desirable that the metal ions to be added should be colorless and stable to heat and light. Specifically, polyvalent ions of transition metals, such as $Cu^{2+}$, $Zn^{2+}$, $Ni^{2+}$, $Pt^{2+}$, $Pd^{2+}$, and $Co^{3+}$, are desirable. In particular, $Zn^{2+}$ is preferred over others.

Such metal ions are generally added in the form of water-soluble compound, such as $ZnSO_4$ or $Zn(CH_3CO_2)_2$ and an appropriate coverage thereof is about 0.01 to about 5 g/m$^2$, particularly 0.1 to 1.5 g/m$^2$.

Image forming dyes to be mordanted in the dye fixing element of this invention include azo, azomethine, anthraquinone, naphthoquinone, styryl, nitro, quinoline, carbonyl and phthalocyanine dyes having an anionic group such as phenolic OH group, sulfonamido group, sulfo group, and carboxyl group.

The fixing element of this invention is used to particular advantage in fixing a diffusible dye which is imagewise formed or released, diffused and then fixed to form a color image.

In the above-described color image forming method, the development can be carried out in various manners, for example, using a developer at a temperature in the vicinity of room temperature (a color diffusion transfer process as described in, e.g., Belgian Patent 757,959), or applying heat in a substantially water-free condition (a heat development process as described in, e.g., European Patent 76492A2, JP-A-58-79247, JP-A-59-218443 and JP-A-61-238056). Any manner of dye transfer can be applied to the dye fixing element of this invention.

The heat developable light-sensitive elements to be used in combination with the dye fixing elements are essentially characterized in that light-sensitive silver halide layers and a binder are provided on a support. Furthermore, the heat developable light-sensitive element optionally may comprise an organometallic salt oxidizing agent, a dye providing compound or the like. (As described later, a reducing agent may concurrently serve as a dye providing compound.) These components may be incorporated in the same layer but may be incorporated in separate layers if they are reactive with each other. For example, if a colored dye providing compound is present in an underlayer of a silver halide emulsion, it can inhibit a decrease in sensitivity. The reducing agent may be preferably incorporated in the heat developable light sensitive element. However, the reducing agent may be supplied from other elements. For example, the reducing agent may be diffused into the heat developable light-sensitive element from a dye fixing element as described later.

In order to obtain a wide range of color in a normal chromaticity diagram with the three primary colors (yellow, magenta and cyan), at least three silver halide emulsion layers having sensitivity in different spectral regions may be used in combination. Examples of such a combination of silver halide emulsion layers include a combination of a blue-sensitive layer, a green-sensitive layer and a red-sensitive layer and a combination of a green-sensitive layer, a red-sensitive layer and an infrared-sensitive layer. These light-sensitive layers may be arranged in various orders commonly used for ordinary color light-sensitive elements (light sensitive materials). These light-sensitive layers may be optionally divided into two or more layers.

The heat developable light-sensitive element may comprise various auxiliary layers such as a protective layer, undercoat layer, interlayer, yellow filter layer, antihalation layer or backing layer.

The silver halide which may be used in the present invention may be any of silver chloride, silver bromide, silver iodobromide, silver chlorobromide, silver chloroiodide and silver chloroiodobromide.

The silver halide emulsion used in the present invention may be a surface latent image type emulsion or an internal latent image type emulsion. The internal latent image type emulsion may be used as a direct reversal emulsion in combination with a nucleating agent or a light fogging agent. Alternatively, the silver halide emulsion may be a core/shell emulsion in which the interior and the surface of the grain are different from each other in phase. The silver halide emulsion may be a monodisperse or polydisperse emulsion or a mixture thereof. The grain size of the emulsion is preferably in the range of from 0.1 to 2 μm, particularly from 0.2 to 1.5 μm. The crystal habit of the silver halide grains may be cubic, octahedral, tetradecahedral or tabular with a high aspect ratio.

In particular, light-sensitive silver halide emulsions as described in U.S. Pat. Nos. 4,500,626 and 4,628,021, *Research Disclosure*, No. 17029 (1978), and JP-A-62-253159 may be used in the present invention.

The silver halide emulsion may be used unripened but is normally used after being chemically sensitized. For emulsions for the light-sensitive materials, known sulfur sensitization processes, reduction sensitization processes and noble metal sensitization processes may be used singly or in combination. These chemical sensitization processes may be optionally effected in the presence of a nitrogen-containing heterocyclic compound as disclosed in JP-A-62-253159.

The amount of the light-sensitive silver halide emulsion coated is in the range of from 1 mg to 10 g/m$^2$ (calculated in terms of amount of silver).

The silver halide used in the present invention may be conventionally spectrally sensitized with a methine dye or the like. Examples of such dyes include cyanine dyes, merocyanine dyes, complex cyanine dyes, complex merocyanine dyes, holopolar cyanine dyes, hemicyanine dyes, styryl dyes and hemioxonol dyes.

Specific examples of dyes include sensitizing dyes as described in U.S. Pat. No. 4,617,257, JP-A-59-180550, JP-A-60-140335, and Research Disclosure, No. 17029 (1978), pp. 12–13.

These sensitizing dyes may be used singly or in combination. In particular, combinations of sensitizing dyes are often used for the purpose of supersensitization.

The light-sensitive silver halide emulsion may comprise a dye which does not exhibit a spectral sensitizing effect by itself or a compound which does not substantially absorb visible light but exhibits a supersensitizing effect (as described in U.S. Pat. No. 3,615,641 and JP-A-63-23145) together with such a sensitizing dye.

Such sensitizing dyes may be incorporated in the emulsion during, before or after chemical sensitization. Alternatively, the sensitizing dye may be incorporated in the emulsion before or after the nucleation of light-sensitive silver halide grains as described in U.S. Pat. Nos. 4,183,756 and 4,225,666. The amount of sensitizing dye incorporated is normally in the range of from $10^{-8}$ to $10^{-2}$ mol per mol of light-sensitive silver halide.

In the present invention, organometallic salts may be used as oxidizing agents in combination with the light-sensitive silver halide. Among such organometallic salts, organic silver salts are particularly preferably used.

Examples of organic compounds which can be used to form such an organic silver salt oxidizing agent include benzotriazoles, fatty acids, and other compounds as described in U.S. Pat. No. 4,500,626 (52nd column to 53rd column). Other useful examples of such organic compounds include carboxylic acid silver salts containing an alkynyl group such as silver phenylpropiolate as described in JP-A-60-113235, and silver acetylide as described in JP-A-61-249044. These organic silver salts may be used in combination.

These organic silver salts are generally used in an amount of from 0.01 to 10 mols, preferably from 0.01 to 1 mol, per mol of light-sensitive silver halide. The total amount of light-sensitive silver salt and organic silver salt coated is preferably in the range of from 50 mg to 10 g/m$^2$ (calculated in terms of amount of silver).

In the present invention, various fog inhibitors or photographic stabilizers may be used. Examples of such fog inhibitors or photographic stabilizers include azoles or azaindenes as described in *Research Disclosure,* No. 17643 (1978), pp. 24–25, nitrogen-containing carboxylic acids or phosphoric acids as described in JP A-59-168442, mercapto compounds and metal salts thereof as described in JP A 59-111636, and acetylenic compounds as described in JP-A-62-87957.

As suitable reducing agents for the present invention there may be used conventional reducing agents known in the field of heat developable light-sensitive elements (light-sensitive materials). Alternatively, reducing dye-providing compounds as described later may be used. These reducing dye-providing compounds may be used in combination with other reducing agents. Further, a reducing agent precursor which does not exhibit a reducing effect but undergoes reaction with a nucleophilic reagent or under heating to exhibit a reducing effect may be used in the present invention.

Examples of reducing agents used in the present invention include reducing agents or reducing agent precursors as described in U.S. Pat. Nos. 4,500,626 (49th column to 50th column), 4,483,914 (30th column to 31st column), 4,330,617, and 4,590,152, JP-A-60-140335, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-60-198540, JP-A-60-181742, JP-A-61-259253, JP-A-62-244044, JP-A-62-131253, JP-A-62-131254, JP-A-62-131255, and JP-A-62-131256, and European Patent 220,746A2 (pp. 78–96).

Combinations of various reducing agents as disclosed in U.S. Pat. No. 3,039,869 may also be used in the present invention.

If a non-diffusible reducing agent is used, an electron transfer agent and/or electron transfer agent precursor may optionally be used in combination therewith in order to accelerate the transfer of electrons between the non-diffusible reducing agent and the developable silver halide.

Such an electron transfer agent or its precursor may be selected from the above described reducing agents or precursors thereof. Such an electron transfer agent or its precursor is preferably greater than the non-diffusible reducing agent (electron donor) in mobility. Particularly useful electron transfer agents are 1-phenyl-3-pyrazolidones or aminophenols.

As non-diffusible reducing agents (electron donors) used in combination with such an electron transfer agent there may be used any of the above described reducing agents which are substantially non-diffusible in the layer of light-sensitive element in which they are located. Preferred examples of such non-diffusible reducing agents include hydroquinones, sulfonamidophenols, sulfonamidonaphthols, compounds described as electron donors in JP-A-53-110827, and non-diffusible reducing dye-providing compounds as later described.

In the present invention, the amount of such reducing agent(s) incorporated is preferably in the range of from 0.001 to 20 mols, particularly from 0.01 to 10 mols per mol of total silver.

In the present invention, as an image-forming substance, a compound which produces or releases a mobile dye in correspondence or counter correspondence to the reduction of silver ions to silver at elevated temperature, i.e., dye-providing compounds, may be incorporated in the light-sensitive material.

Examples of such dye-providing compounds which may be used in the present invention include compounds which undergo an oxidation coupling reaction with a color developing agent to form a dye (coupler). Such a coupler may be a two-equivalent coupler or four-equivalent coupler. A two-equivalent coupler containing a nondiffusible group as a split-off group which undergoes oxidation coupling reaction to form a diffusible dye is preferably used. Specific examples of suitable developing agents and couplers are described in T. H. James, *The Theory of the Photographic Process*, pp. 291–334 and 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Examples of different dye-providing compounds include compounds which serves to imagewise release or diffuse a diffusible dye. Such a compound can be represented by the following general formula (LI):

$$(\text{Dye-Y})_n\text{—Z} \qquad \text{(LI)}$$

wherein Dye represents a dye group, a dye group which has been temporarily shifted to a short wavelength range or a dye precursor group; Y represents a mere bond or connecting group; Z represents a group which makes a difference in the diffusibility of the compound represented by $(\text{Dye-Y})_n \geqq \text{Z}$ in corresponding or counter-corresponding to light-sensitive silver salts having a latent image distributed imagewise or releases Dye in corresponding or counter-corresponding to light-sensitive silver salts having a latent image distributed imagewise to make no difference in the diffusibility between Dye thus released and $(\text{Dye-Y})_n$—Z; and n represents an integer of 1 or 2. If n is 2, two (Dye-Y)'s may be the same or different.

Specific examples of the dye-providing compound represented by the general formula (LI) include the following compounds i to v. The compounds i to iii form a diffusible dye image (positive dye image) in counter-corresponding to the development of silver halide while the compounds iv and v form a diffusible dye image (negative dye image) in corresponding to the development of silver halide.

i. Dye developing agents comprising a hydroquinone developing agent connected to a dye component as described in U.S. Pat. Nos. 3,134,764, 3,362,819, 3,597,200, 3,544,545, and 3,482,972. These dye developing agents are diffusible in alkaline conditions but become nondiffusible upon reaction with silver halide.

ii. Nondiffusible compounds which release a diffusible dye in alkaline conditions but lose their function upon reaction with silver halide as described in U.S. Pat. No. 4,503,137. Examples of such compounds include compounds which undergo intramolecular nucleophilic displacement reactions to release a diffusible dye as described in U.S. Pat. No. 3,980,479, and compounds which undergo an intramolecular rewinding reaction of the isooxazolone ring to release a diffusible dye as described in U.S. Pat. No. 4,199,354.

iii. Nondiffusible compounds that react with a reducing agent left unoxidized after being developed to release a diffusible dye as described in U.S. Pat. No. 4,559,290, European Patent 220,746A2, and Kokai Giho 87-6,199.

Examples of such compounds include compounds which undergo intramolecular nucleophilic displacement reaction after being reduced to release a diffusible dye as described in U.S. Pat. Nos. 4,139,389 and 4,139,379, and JP-A-59-185333, and JP-A-57-84453, compounds which undergo an intramolecular electron transfer reaction after being reduced to release a diffusible dye as described in U.S. Pat. No. 4,232,107, JP-A-59-101649, JP-A-61-88257, and *Research Disclosure*, No. 24,025 (1984), compounds which undergo cleavage of a single bond after being reduced to release a diffusible dye as described in West German Patent 3,008,588A, JP-A-56-142530, and U.S. Pat. Nos. 4,343,893, and 4,619,884, nitro compounds which receive electrons to release a diffusible dye as described in U.S. Pat. No. 4,450,223, and compounds which receive electrons to release a diffusible dye as described in U.S. Pat. No. 4,609,610.

Preferred example of such compounds include compounds containing an N-X bond (wherein X represents oxygen atom, sulfur atom or nitrogen atom) and an electrophilic group in one molecule as described in European Patent 220,746A2, Kokai Giho 87-6,199, JP-A-63-201653, and JP-63-201654, compounds containing an $SO_2$—X group (wherein X is as defined above) and an electrophilic group in one molecule as described in U.S. application Ser. No. 07/188,779, compounds containing a PO—X bond (wherein X is as defined above) and an electrophilic group in one molecule as described in JP-A-63-271344, and compounds containing a C—X' bond (wherein X' is as defined above for X or represents —$SO_2$—) and an electrophilic group in one molecule as described in JP-A-63-271341.

Particularly preferred among these compounds are compounds containing an N—X bond and an electrophilic group in one molecule. Specific examples of such compounds include Compounds (1) to (3), (7) to (10), (12), (13), (15), (23) to (26), (31), (32), (35), (36), (40), (41), (44), (53) to (59), (64), and (70) described in European Patent 220,746A2, and Compounds (11) to (23) described in Kokai Giho 87-6,199.

iv. Couplers containing a diffusible dye as the split-off group which reacts with an oxidation product of a reducing agent to release a diffusible dye (DDR coupler). Specific examples of such compounds include those described in British Patent 1,330,524, JP-B-48-39165, and U.S. Pat. Nos. 3,443,940, 4,474,867, and 4,483;914.

v. Compounds which are capable of reducing silver halide or organic silver salts and release a diffusible dye after reducing silver halide or organic silver salts (DDR compound). These compounds are advantageous in that they need no other reducing agents. They eliminate image staining due to the action of oxidation decomposition products of reducing agents. Typical examples of such compounds are described in U.S. Pat. Nos. 3,928,312, 4,053,312, 4,055,428, 4,336,322, 3,725,062, 3,728,113, 3,443,939, and 4,500,626, JP-A-59- 65839, JP-A-59-69839, JP-A-53-3819, JP-A-51-104343, JP-A-58-116537, JP-A-57-179840, and *Research Disclosure*, No. 17,465. Specific examples of DRR compounds include compounds as described in U.S. Pat. No. 4,500,626, 22nd column to 44th column, and particularly preferred among these compounds are compounds (1) to (3), (10) to (13), (16) to (19), (28) to (30), (33) to (35), (38) to (40), and (42) to (64). Other preferred examples of such compounds include those described in U.S. Pat. No. 4,639,408, 37th column to 39th column.

Examples of dye-providing compounds other than the above described couplers and compounds of the general formula [LI] include silver dye compounds comprising an organic silver salt connected to a dye as described in *Research Disclosure* (May 1978, pp. 54–58), azo dyes for use in heat developable silver dye bleaching processes as described in U.S. Pat. No. 4,235,957 and *Research Disclosure* (April 1976, pp. 30–32), and leuco dyes as described in U.S. Pat. Nos. 3,985,565 and 4,022,617.

The incorporation of a hydrophobic additive such as a dye-providing compound or a non-diffusible reducing agent in a layer of light-sensitive element can be accomplished by any known method as described in U.S. Pat. No. 2,322,027. In this case, a high boiling organic solvent as described in JP-A-59-83154, JP-A-59-178451, JP-A-59-178452, JP-A-59-178453, JP-A-59-178454, JP-A-59-178455, and JP-A-59-178457 may optionally be used in combination with a low boiling organic solvent having a boiling point of from 50° to 160° C.

The amount of such a high boiling organic solvent incorporated is generally in the range of from 1 to 10 g, preferably 5 g or less, per gram of dye-providing compound used or 1 cc or less, preferably 0.5 cc or less, particularly preferably 0.3 cc or less, per gram of binder.

A dispersion process as described in JP-B-51-39853 and JP-A-51-59943 which comprises using a polymerization product may also be used.

If a compound which is substantially insoluble in water is used, it may be incorporated in the binder in the form of dispersion of finely divided particles rather than by the above described processes.

In order to disperse a hydrophobic compound in a hydrophilic colloid, various surface active agents can be used. Examples of such surface active agents which may be used in this dispersion process include those described as surface active agent in JP-A-59-157636 (pp. 37–38).

In the present invention, a compound which serves both to accelerate the development of light-sensitive materials and stabilize images may be used. Specific examples of such compounds preferably used in the present invention are described in U.S. Pat. No. 4,500,626 (51st column to 52nd column).

Examples of film hardeners which may be incorporated in the constituent layers of the light-sensitive element or dye fixing element include those described in U.S. Pat. No. 4,678,739 (41st column), JP-A-59-116655, JP-A-62-245261, and JP-A-61-18942. Specific examples of such film hardeners include aldehyde film hardeners (e.g., formaldehyde), aziridene film hardeners, epoxy film hardeners (e.g.,

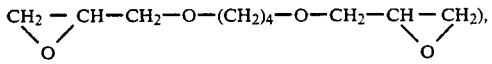

vinylsulfone film hardeners (e.g., N,N'-ethylenebis(-vinylsulfonylacetamido)ethane), N-methylol film hardeners (e.g., dimethylol urea), and high molecular film hardeners (e.g., compounds as described in JP-A-62-234157).

In the present invention, the light-sensitive element and/or dye fixing element may include an image formation accelerator. Such an image formation accelerator serves to accelerate a redox reaction between a silver salt oxidizing agent and a reducing agent, accelerate production or decomposition of a dye from a dye providing compound or release of a diffusible dye from the dye providing compound, or accelerate transfer of a dye from a light-sensitive material layer to a dye fixing layer. From the physicochemical standpoint, image formation accelerators can be classified into various groups such as base o base precursor, nucleophilic compound, high boiling organic solvent (oil), thermal solvent, surface active agent, and compounds capable of interacting with silver or silver ion. However, these groups normally have composite functions and therefore exhibit a combination of the above described accelerating effects. Details are given in U.S. Pat. No. 4,678,739 (38th column to 40th column).

Examples of such base precursors include salts of an organic acid capable of being heat-decarboxylated with a base, and compounds which undergo an intramolecular nucleophilic displacement reaction, Lossen rearrangement or Beckman rearrangement to release an amine. Specific examples of such base precursors are described in U.S. Pat. No. 4,511,493 and JP-A-62-65038.

In a system where heat development and dye transfer are simultaneously effected in the presence of a small amount of water, such a base and/base precursor may be preferably incorporated in the dye fixing element to improve the storage stability of the light-sensitive element.

Other examples of suitable base precursors include a combination of a sparingly soluble metallic compound and a compound capable of complexing with metal ions constituting said metallic compound as described in European Patent 210,660A, and a compound as described in JP-A-61-232451 which undergoes electrolysis to produce a base. Particularly, the former compound may be effectively used. The sparingly soluble metallic compound and the complexing compound may advantageously be incorporated separately in the light-sensitive element and the dye fixing element.

The present light-sensitive element and/or dye fixing element may comprise various development stopping agents for the purpose of providing images resistant against fluctuations in temperature and time for development.

The term "development stopping agent" as used herein means a compound which readily neutralizes or reacts with a base to reduce the base concentration in the film to stopping development, or which interacts with silver or silver salt to inhibit development after a proper development period. Specific examples of such compounds include acid precursors which release an acid on heating, electrophilic compounds which undergo a displacement reaction with a base present therewith on heating, and nitrogen-containing heterocyclic compounds, mercapto compounds and precursors thereof.

Details are given in JP-A-62-253159 (pp. 31–32).

The constituent layers (including the backing layer) of the light-sensitive element or dye fixing element may comprise various polymer latexes for the purpose of dimensional stability, inhibiting curling, adhesion, film cracking and pressure sensitization or desensitization or improving other film properties. Specific examples of suitable polymer latexes which may be used include those described in JP-A-62-245258, JP-A-62-136648, and JP-A-62-110066. In particular, if a polymer latex having a low glass transition point (40° C. or lower) is incorporated in the mordant layer, cracking of the mordant layer can be prevented. If a polymer latex having a high glass transition point is incorporated in the backing layer, an anticurling effect can be provided.

The constituent layers of the light-sensitive element or dye fixing element may comprise a high boiling organic solvent as a plasticizer, lubricant or agent for improving the strippability of the light-sensitive element from the dye fixing element. Specific examples of such a high boiling organic solvent include those described in JP-A-62-253159 (page 25) and JP-A-62-245253.

For the above described purposes, various silicone oils ranging from dimethyl silicone oil to modified silicone oil obtained by incorporating various organic groups into dimethylcycloxane may be used. For example, various modified silicone oils, particularly carboxy-modified silicone (trade name: X-22-3710), described at pp. 6–8 of "Modified Silicone Oil", technical data reported by Shin-Etsu Silicone Co., Ltd., may be effectively used.

Silicone oils as described in JP-A-62-215953 and JP-A-63-46449 may also be effectively used.

The light-sensitive element or dye fixing element may comprise a discoloration inhibitor. As such a discoloration inhibitor there may be used an antioxidant, ultraviolet absorber or certain kinds of metal complexes.

Examples of such an antioxidant include chroman compounds, coumaran compounds, phenol compounds (e.g., hindered phenols), hydroquinone derivatives, hindered amine derivatives, and spiroindane compounds. Other useful antioxidants include compounds as described in JP-A-61-159644.

Examples of suitable ultraviolet absorbers include benzotriazole compounds as described in U.S. Pat. No. 3,533,794, 4-thiazolidone compounds as described in U.S. Pat. No. 3,352,681, benzophenone compounds as described in JP-A-46-2784, and compounds as described in JP-A-54 48535, JP-A-62-136641, and JP-A-61-8256. Other useful ultraviolet absorbers include ultraviolet-absorbing polymers as described in JP-A-62-260152.

Examples of suitable metal complexes include compounds as described in U.S. Pat. Nos. 4,241,155, 4,245,018, (3rd column to 36th column), and 4,254,195 (3rd column to 8th column), JP-A-62-174741, JP-A-61-88256 (pp. 27-29), and JP-A-63-199248.

Useful examples of other discoloration inhibitors are described in JP-A-62-215272 (pp. 125–137).

A discoloration inhibitor for inhibiting discoloration of a dye to be transferred to the dye fixing element may be previously incorporated in the dye fixing element or supplied into the dye fixing element from other elements such as light-sensitive element.

The above described antioxidants, ultraviolet absorbers and metal complexes may be used in combination.

The light sensitive element or dye fixing element may comprise a fluorescent brightening agent. In particular, such a fluorescent brightening agent may be incorporated in the dye fixing element or supplied into the dye fixing element from other elements such as light-sensitive element. Examples of such fluorescent brightening agents include compounds as described in K. Veenkataraman, *The Chemistry of Synthetic Dyes,* Vol. V, Chapter 8, and JP-A-61-143752. Specific examples of such compounds include stilbene compounds, coumarin compounds, biphenyl compounds, benzoxazolyl compounds, naphthalimide compounds, pyrazoline compounds, and carbostyryl carboxy compounds.

Such a fluorescent brightening agent may be used in combination with a discoloration inhibitor.

The constituent layers of the light-sensitive element or dye fixing element may comprise various surface active agents for the purpose of aiding of coating, improving strippability and lubricity, inhibiting static electrification or accelerating development. Specific examples of such surface active agents are described in JP-A-62-173463 and JP-A-62-183457.

The constituent layers of the light-sensitive element or dye fixing element may comprise an organofluoro compound for the purpose of improving lubricity and strippability or inhibiting static electrification. Typical examples of such an organofluoro compound include fluorine surface active agents as described in JP-B-57-9053 (8th column to 17th column), JP-A-61-20944, and JP-A-62-135826, and hydrophobic fluorine compounds such as oily fluorine compounds (e.g., fluorine oil) or solid fluorine compound resins (e.g., tetrafluoroethylene resin).

Furthermore, the constituent layers of the light-sensitive element or dye fixing element may comprise a thermal solvent, an anti-foaming agent, an anti-bacterial and anti-fungal agent or colloidal silica. Specific examples of these additives are described in JP-A-61-88256 (pp. 26–32).

As a suitable support for the dye fixing element or light-sensitive element, there may be used a material capable of withstanding the processing temperature. In general, paper or a synthetic high molecular weight compound (film) may be used. Specific examples of such a support material which may be used in the present invention include polyethylene terephthalate polycarbonates, polyvinyl chloride, polystyrene, polypropylene, polyimides or celluloses (e.g., triacetyl cellulose) or a material obtained by incorporating a pigment such as titanium oxide in such a film, a synthetic paper film formed of polypropylene or the like, a mixed paper made of synthetic resin pulp such as polyethylene and natural pulp, Yankee paper, baryta paper, coated paper (particularly cast coat paper), metals, fabrics, and glass.

Such a support material may be used as it is or in the form of a material laminated with a synthetic high molecular weight compound such as polyethylene on one or both sides thereof.

Alternatively, a support material as described in JP-A 62-253159 (pp. 29–31) may be used in the present invention.

These support materials may be coated with a hydrophilic binder, a semiconducting metal oxide such as alumina sol or tin oxide, carbon black or other antistatic agents.

Examples of process for exposing the light-sensitive element to light for imaging include processes which comprise using a camera to photograph scenery or persons, processes which comprise using a printer or enlarger to expose the light-sensitive material to light through a reversal film or negative film, processes which comprise using an exposing machine such as a copying machine to effect scanning exposure of the light-sensitive material to an original through a slit, processes which comprise exposing the light-sensitive material to light representative of image data emitted by a light emitting diode or various lasers, and processes which comprise exposing the light-sensitive material directly or through an optical system to light representative of image data emitted by an image display apparatus such as a CRT, liquid crystal display, electroluminescence display or plasma display.

As a light source for recording images on the light-sensitive material there may be used natural light, tungsten lamp, a light emitting diode, a laser, a CRT or light sources as described in U.S. Pat. No. 4,500,626 (56th column).

Examples of image data which can be recorded on the present light-sensitive material include picture signals from a video camera, electron still camera or the like, a television signal according to Nippon Television Signal Code (NTSC), a picture signal obtained by dividing an original into many pixels by means of a scanner or the like, and a picture signal produced by means of a CG, CAD or like computer.

The heating temperature at which heat development can be effected is preferably in the range of from about 50° C. to about 250° C., particularly from about 80° C. to about 180° C. The dye diffusion transfer process may be effected simultaneously with or after heat development. In the latter case, the heating temperature at which dye transfer can be effected is preferably in the range of from the heating temperature for heat development to room temperature, particularly from 50° C. to a temperature about 10° C. lower than the heating temperature for heat development.

The transfer of a dye can be effected by heating alone. In order to accelerate the dye transfer, a solvent may be used.

Alternatively, a process as described in JP-A-59-218443 and JP-A-61-238056 which comprises heating the light-sensitive material in the presence of a small amount of a solvent, particularly water, to effect development and dye transfer simultaneously or in sequence may be effectively used. The heating temperature for this process is preferably in the range of from 50° C. to a temperature not higher than the boiling point of the solvent. For example, if the solvent is water, the heating temperature is preferably in the range of from 50° C. to 100° C.

Examples of a solvent which may be used to accelerate development and/or transfer of a diffusible dye to the dye fixing layer include water and a basic aqueous solution containing an inorganic alkali metal salt or organic base as described with reference to the image formation accelerators. Other useful examples of solvents include a low boiling solvent and a mixed solution made of such a low boiling solvent and water or a basic aqueous solution. Such a solvent may further comprise a surface active agent, fog inhibitor, sparingly soluble metal salt, complexing compound or the like.

These solvents may be incorporated in either or both of the light-sensitive element and the dye fixing element. The amount of the solvent incorporated in the light-sensitive element and/or dye fixing element may be small such as not more than the weight of the solvent in a volume corresponding to the maximum swelling volume of the total coated films (particularly, not more than the value obtained by subtracting the weight of the entire coated film(s) from the weight of the solvent in a volume corresponding to the maximum swelling volume of the entire coated film(s)) in the light-sensitive or dye fixing solvent.

As the process for incorporating the solvent in the light-sensitive layer or dye fixing layer, those described in JP-A-61-147244 (page 26) can be referenced. Alternatively, the solvent may be incorporated in either or both of the light-sensitive element and the dye fixing element in a microcapsule form or like form.

In order to accelerate transfer of a dye, a hydrophilic thermal solvent which stays solid at normal temperature but dissolves at an elevated temperature may be incorporated in the light-sensitive element or dye fixing element. Such a hydrophilic thermal solvent may be incorporated in either or both of the light-sensitive element and the dye fixing element. The layer in which the solvent is incorporated may be any one of emulsion layer, interlayer, protective layer and dye fixing layer, preferably the dye fixing layer and/or a layer adjacent thereto.

Examples of such a hydrophilic thermal solvent include ureas, pyridines, amides, sulfonamides, imides, anisoles, oximes and other heterocyclic compounds.

In order to accelerate the transfer of a dye, a high boiling organic solvent may be incorporated in the light-sensitive element and/or dye fixing element.

Examples of heating processes at development and/or the dye transfer step include processes which comprise bringing the light-sensitive material into contact with a heated block or plate, processes which comprise bringing the light-sensitive material into contact with a heating plate, hot presser, heat roller, halogen lamp heater, infrared or far infrared lamp heater or the like, and processes which comprises passing the light-sensitive material through a high temperature atmosphere. Alternatively, the light-sensitive element or dye fixing element may be provided with a resistive heating element layer so that it is heated by passing an electric current through the resistive heating element layer. As such a resistive heating element layer there may be used the one described in JP-A-61-145544.

As the pressure conditions and pressure application processes for the lamination of the light-sensitive element and the dye fixing element, those described in JP-A-61-147244 (p. 27) can be used.

For the photographic processing of the photographic element, any suitable heat developing apparatus may be employed.

Examples of such a heat developing apparatus preferably used in the present invention include those described in JP-A-59-75247, JP-A-59-177547, JP-A-59-181353, JP-A-60-18951, and JP A U 62-25944 (the term "JP-A-U" as used herein means an "unexamined published Japanese utility model application").

The present invention will be further described in the following examples, but the present invention should not be construed as being limited thereto.

EXAMPLE 1

A light-sensitive material was prepared in the same manner as the light-sensitive material 101 prepared in Example 1 of JP-A-62-174754. This material was named light-sensitive element 101.

Next, dye fixing elements R-101 to R-119 were prepared so as to have their respective constitutions shown in Table 2 and Table 3.

The presence or the absence of the phase separation in the coating solutions for the protective layers of the foregoing samples are shown in Table 3.

TABLE 2

Constitution of Dye Fixing Element

| Constituent Layer | Additives | Amount Added ($g/m^2$) |
|---|---|---|
| The third layer | Teflon ® 30J (1)* | 0.04 |
| | Surfactant (1)* | 0.001 |
| | Surfactant (2)* | 0.02 |
| | Surfactant (3)* | 0.10 |
| | Guanidinopicolinic acid | 0.45 |
| | Water soluble polymer A | X |
| | Water soluble polymer B | Y |
| The second layer | Mordant (1)* | 2.35 |
| | Water soluble polymer (1)* | 0.21 |
| | Gelatin | 1.40 |
| | Water soluble polymer (2)* | 0.60 |
| | Antioxidant (1)* | 1.2 |
| | Ultraviolet absorbent (1)* | 0.9 |
| | High boiling solvent (1)* | 1.40 |

TABLE 2-continued

| Constitution of Dye Fixing Element | | |
|---|---|---|
| | Guanidiopicolinic acid | 1.80 |
| | Surfactant (4)* | 0.02 |
| The first layer | Gelatin | 0.45 |
| | Surfactant (3)* | 0.01 |
| | Water soluble polymer (1)* | 0.04 |
| | Hardener (1)* | 0.30 |
| Support | Polyethylene layer (1) | 45 microns |
| | Cast-coated layer | 10 microns |
| | Coated layer | 10 microns |
| | Plain paper | 60 microns |
| | Coated layer | 10 microns |
| | Polyethylene layer (2) | 35 microns |
| The first backing layer | Gelatin | 3.25 |
| | Hardener (1)* | 0.25 |
| The second backing layer | Gelatin | 0.44 |
| | Silicone oil (1)* | 0.08 |
| | Surfactant (4)* | 0.05 |
| | Matting agent (2)* | 0.09 |
| | Surfactant (5)* | 0.01 |

Teflon ® 30J (1)*
Disperson of Teflon ® fine particles (0.1-1 micron), produced by DuPont-Mitsui Fluorochemical, Co., Ltd.

Surfactant (1)*

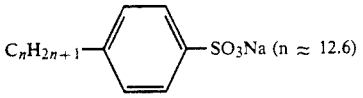

Surfactant (2)*

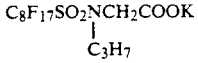

Surfactant (3)*

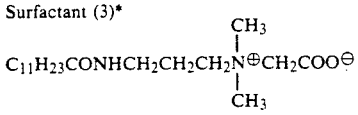

Surfactant (4)*

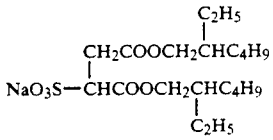

Surfactant (5)*

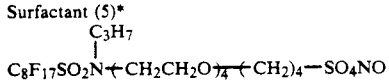

Water soluble polymer (1)*
Sumikagel ® 5L-H' (produced by Sumitomo Chemical Co., Ltd.)

Water soluble polymer (2)*
Dextran (molecular weight: 70,000)

Mordant (1)*

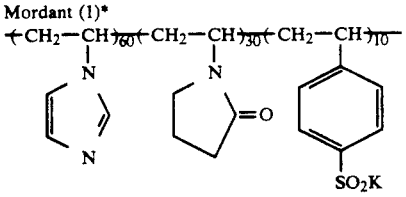

High boiling organic solvent (1)*
Reofos ® 95 (produced by Ajinomoto Co., Inc.)

Hardener (1)*

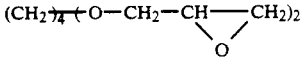

Matting agent (2)*

TABLE 2-continued

| Constitution of Dye Fixing Element |
|---|
| Benzoguanamine resin (average particle size: 15 microns) |

Antioxidant (1)*

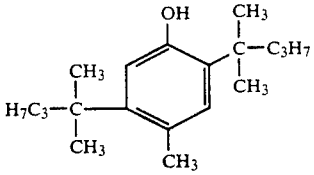

Ultraviolet absorbent (1)*
1:1:1 (by weight) mixture of

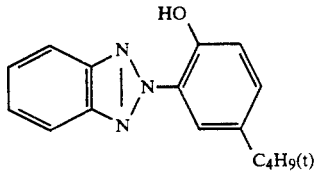

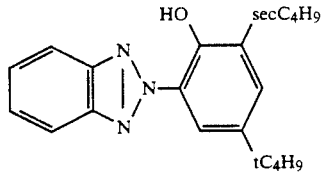

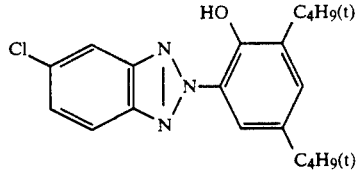

The high boiling solvent (1) was added to the coating solution in the form of an emulsion prepared by dispersing it into a 10% gelatin aqueous solution with a homogenizer using the surfactant (4) as dispersant.

The antioxidant and the ultraviolet absorbent were dissolved in the foregoing high boiling solvent (1), emulsified in the same manner as described above, and then added to the coating solution.

The support was prepared in the following manner: Esprit Coat ® C paper (produced by Sanyo-Kokusaku Pulp Co., Ltd., and having a basis weight of 105 g/m$^2$) was laminated on both sides with a polyethylene film (surface side: polyethylene (low density) film containing 9.6% titanium white and 0.3% of bluish pigment and having a thickness of 45 microns, back side: polyethylene (high density) film having a thickness of 35 microns), subjected to corona discharge treatment on both sides, and then coated with a subbing layer containing gelatin as a main component.

In Table 3, the kinds and the amounts of water soluble polymers A and B used in the third layer of each dye fixing element, the phase-separated condition in the coating solution for the third layer of each dye fixing element (○ mark means that when a coating solution for the third layer was poured into a measuring cylinder and allowed to stand for 24 hours at 40° C. the solution did not separate into upper and lower two phases), and the surface appearance after coating and drying procedures (K=glossy surface, M=mat surface) is shown.

TABLE 3

| Dye Fixing Element | Water Soluble Polymer A | X g/m² | Water Soluble Polymer B | Y g/m² | Phase Separation of Coating Solution*1 | Surface Appearacne*2 |
|---|---|---|---|---|---|---|
| R-101 (Comparison) | Gelatin | 0.3 | — | | ○ | K |
| R-102 (Comparison) | Sodium polymethacrylate (low polymerization degree) | 0.3 | — | | ○ | K |
| R-103 (Comparison) | Ammonium polyacrylate (low polymerization degree) | 0.3 | — | | ○ | K |
| R-104 (Invention) | Ammonium polyacrylate (low polymerization degree) | 0.15 | Sodium polymethacrylate | 0.15 | ○ | M |
| R-105 (Invention) | Sodium polyacrylate (low polymerization degree) | 0.15 | Sodium polymethacrylate | 0.15 | ○ | M |
| R-106 (Invention) | Polyacrylamide | 0.15 | Sodium polymethacrylate | 0.15 | ○ | M |
| R-107 (Comparison) | Hydroxyethyl cellulose | 0.3 | — | | ○ | K |
| R-108 (Invention) | Sodium polymethacrylate | 0.15 | Hydroxylethyl cellulose | 0.15 | ○ | M |
| R-109 (Invention) | Sodium polymethacrylate | 0.15 | Block copolymer of vinyl alcohol acrylic acid | 0.15 | ○ | M |
| R-110 (Comparison) | — | | Block copolymer of vinyl alcohol and acrylic acid | 0.3 | ○ | M |
| R-111 (Comparison) | Phthalized gelatin | 0.3 | — | | ○ | K |
| R-112 (Comparison) | Polyacrylamide | 0.3 | — | | ○ | K |
| R-113 (Invention) | " | 0.15 | Phthalized gelatin | 0.15 | ○ | M |
| R-114 (Invention) | " | 0.15 | Polyethylene glycol (polymerization degree: 20,000) | 0.15 | ○ | M |
| R-115 (Invention) | Poly(potassium vinylbenzenesulfonate) | 0.15 | Polymer B of the Combination No. 17 in Table 1 | 0.15 | ○ | M |
| R-116 (Invention) | Sodium polyacrylate | 0.1 | Sodium polymethacrylate | 0.1 | ○ | M |
| R-117 (Invention) | Sodium polyacrylate | 0.23 | Sodium polymethacrylate | 0.3 | ○ | M |
| R-118 (Invention) | Polyethylene glycol (polymerization degree: 20,000) | 0.15 | Sodium alginate | 0.15 | ○ | M |
| R-119 (Invention) | Hydroxyethyl cellulose | 0.15 | Polyvinyl alcohol | 0.15 | ○ | M |

Images were formed using these elements in the following manner.

The color light-sensitive element 101 having the foregoing multilayer structure was subjected to a $10^{-4}$ exposure with a xenon flash lamp. Therein, the exposure was carried out through separation filters G, R and IR, which each had continuously changed density.

To the emulsion surface of the exposed light-sensitive element, 12 ml/m² of water was supplied with a wire bar. Thereafter, the resulting element was superimposed upon each of the foregoing dye fixing elements (image-receiving elements) R-101 to R-119 so as to come into face-to-face contact.

The superimposed elements were heated for 25 seconds with heating rollers the temperature of which was controlled so that the temperature of the water-absorbed layers might be raised up to 90° C., and then the dye fixing element was peeled apart from the light-sensitive element, resulting in the formation of yellow, magenta and cyan images in the dye fixing element corresponding to the separation filters G, R and IR.

As shown in Table 3, the surface appearance of the dye fixing elements containing high molecular binders combined in accordance with this invention was matted.

Moreover, the maximum image densities (Dmax) attained by this invention were sufficient to look at, though the measured values thereof (1.8–2.0) were lowered by about 0.2 in proportion as the surface was matted. In contrast to this invention, when the surface was matted with a matting agent (e.g., when silica having an average particle size of 4 microns was used in the third layer at a coverage of 0.12 g/m²), Dmax was lowered by about 0.4.

EXAMPLE 2

A positive light-sensitive element having such a constitution as to be shown in Table 4 was prepared.

The color light-sensitive element having the above-described multilayer structure was exposed to a tungsten lamp for 1 second under illuminance of 200 lux through separation filters B, G, R and gray, whose densities each was continuously changed, i.e., a wedge.

To the emulsion surface of the exposed light-sensitive element, 20 ml/m$^2$ of water was supplied with a wire bar. Thereafter, the resulting element was superimposed upon each of the dye fixing elements prepared in Example 1, R-101 to R-119, so as to come into a face-to-face contact.

The superimposed elements were heated for 20 seconds with heating rollers the temperature of which was controlled so that the temperature of the water-absorbed layers might be raised up to 90° C., and then the dye fixing element was peeled apart from the light-sensitive element, resulting in the formation of clear images of green, red and gray colors in the dye fixing element corresponding to the separation filters.

Similarly to the results of Example 1, the surface appearance in the cases where only one kind of hydrophilic polymer was used in the third layer of the dye fixing element was all glossy, but that of the dye fixing elements of this invention R-104 to R-106, R-108, R-109 and R-113 to R-119 was all matted.

TABLE 4

| Layer No. | Layer Name | Additives | Amount Added (g/m$^2$) |
|---|---|---|---|
| 6th | Protective layer | Gelatin | 0.91 |
| | | Matting agent (silica) | 0.03 |
| | | Water soluble polymer (1)* | 0.23 |
| | | Surfactant (1)* | 0.06 |
| | | Surfactant (2)* | 0.13 |
| | | Hardener (1)* | 0.01 |
| | | $ZnSO_4.7H_2O$ | 0.06 |
| 5th | Blue-sensitive layer | Emulsion (III) on Ag Basis | 0.58 |
| | | Gelatin | 0.68 |
| | | Antifoggant (1)* | $1.36 \times 10^{-3}$ |
| | | Yellow dye providing substance (1)* | 0.50 |
| | | High boiling solvent (1)* | 0.25 |
| | | Electron donor (ED-11) | 0.25 |
| | | Surfactant (3)* | 0.05 |
| | | Electron transfer agent (X-22) | 0.03 |
| | | Hardener (1)* | 0.01 |
| | | Water soluble polymer (2)* | 0.02 |
| 4th | Interlayer | Gelatin | 0.75 |
| | | $Zn(OH)_2$ | 0.32 |
| | | Reducing agent (ED-37) | 0.11 |
| | | Surfactant (1)* | 0.02 |
| | | Water soluble polymer (2)* | 0.02 |
| | | Hardener (1)* | 0.01 |
| 3rd | Green-sensitive layer | Emulsion (II) on Ag Basis | 0.41 |
| | | Gelatin | 0.47 |
| | | Antifoggant (1)* | $1.25 \times 10^{-3}$ |
| | | Magenta dye providing substance (2)* | 0.37 |
| | | High boiling solvent (1)* | 0.19 |
| | | Electron donor (ED-11) | 0.14 |
| | | Surfactant (3)* | 0.04 |
| | | Electron transfer agent (X-22) | 0.03 |
| | | Hardener (1)* | 0.01 |
| | | Water soluble polymer (2)* | 0.02 |
| 2nd | Interlayer | Gelatin | 0.80 |
| | | $Zn(OH)_2$ | 0.31 |
| | | Reducing agent (ED-37) | 0.11 |
| | | Surfactant (1)* | 0.06 |
| | | Surfactant (4)* | 0.10 |
| | | Water soluble polymer (2)* | 0.03 |
| | | Hardener (1)* | 0.01 |
| 1st | Red-sensitive layer | Emulsion (I) on Ag basis | 0.36 |
| | | Sensitizing dye (D-51) | $1.07 \times 10^{-3}$ |
| | | Gelatin | 0.49 |
| | | Antifoggant (1)* | $1.25 \times 10^{-3}$ |
| | | Cyan dye providing substance (3)* | 0.37 |
| | | High boiling solvent (1)* | 0.18 |
| | | Electron donor (ED-11) | 0.14 |
| | | Surfactant (3)* | 0.04 |
| | | Electron transfer agent (X-22) | 0.03 |
| | | Hardener (1)* | 0.01 |
| | | Water soluble polymer (2)* | 0.02 |
| Support (polyethylene terephthalate film, 100μ thick) | | | |
| Backing layer | | Carbon black | 0.44 |
| | | Polyester | 0.30 |
| | | Polyvinyl chloride | 0.30 |

Water soluble polymer (1)* Sumikagel ® L-5(H), produced by Sumitomo Chemical Co., Ltd.

TABLE 4-continued
Water soluble polymer (2)* 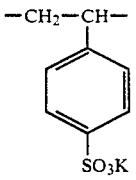
(molecular weight: about 800,000)
Surfactant (1)* Aerosol ® OT
Surfactant (2)* 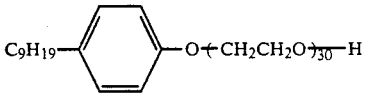
Surfactant (3)* 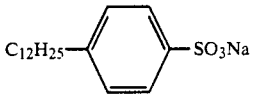
Surfactant (4)* 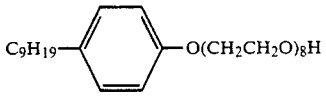
Hardener (1)* 1,2-Bis(vinylsulfonylacetamido)ethane
High boiling solvent (1)* Tricyclohexyl phosphate
Antifoggant (1)* 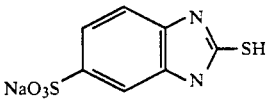
Electron donor (ED-11)* 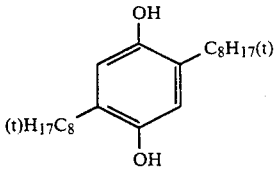
Reducing agent (ED-37)* 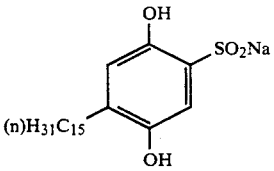
Yellow dye providing substance (1)*
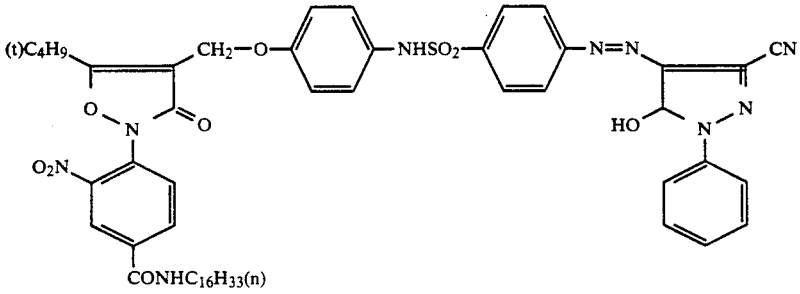

TABLE 4-continued

Magenta dye providing substance (2)*

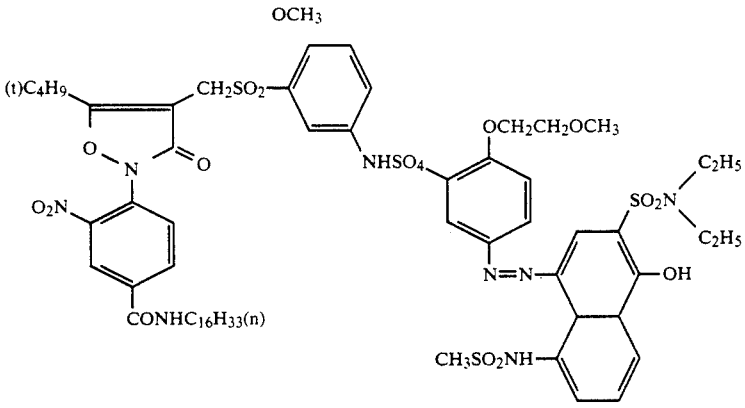

Cyan dye providing substance (3)*

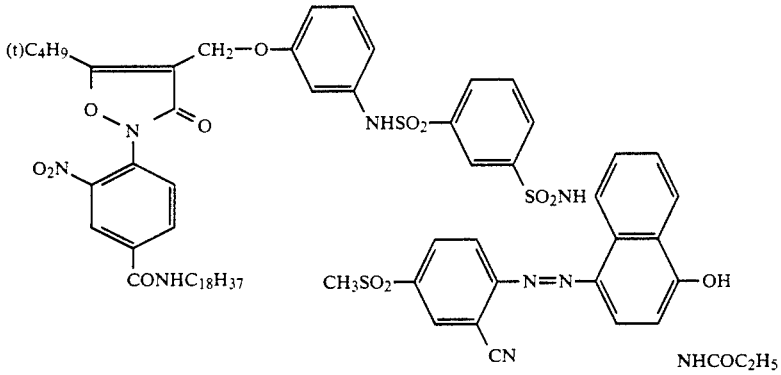

Electron transfer agent (X-22)

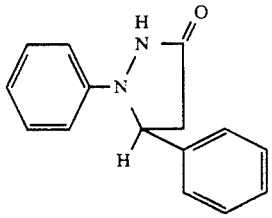

Sensitizing dye (D-51)

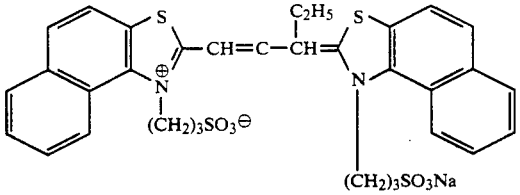

The emulsion (I) for the first layer was prepared as follows.

To a well stirred aqueous gelatin solution (containing 20 g of gelatin and 3 g of sodium chloride in 1,000 ml of water, and kept at 75° C.), 600 ml of an aqueous solution containing sodium chloride and potassium bromide and an aqueous silver nitrate solution (containing 0.59 mole of silver nitrate in 600 ml of water) were simultaneously added at the same flow rate over a period of 40 minutes. Thus, a monodisperse cubic silver chlorobromide emulsion (bromide content: 80 mol %, average grain size: 0.35 micron) was prepared.

After washing and desalting steps, the emulsion was chemically sensitized by addition of 5 mg of sodium thiosulfate and 20 mg of 4-hydroxy-6-methyl-1,3,3a,7-tetraazaindene at a temperature of 60° C. The yield of the emulsion was 600 g.

The emulsion (II) for the third layer was prepared as follows.

To a well-stirred aqueous gelatin solution (containing 20 g of gelatin and 3 g of sodium chloride in 1,000 ml of water, and kept at 75° C.), 600 ml of an aqueous solution containing sodium chloride and potassium bromide, an aqueous silver nitrate solution (containing 0.59 mole of silver nitrate in 600 ml of water), and a dye solution (I) described below were simultaneously added at the same flow rate over a period of 40 minutes. Thus, a dye-adsorbed monodisperse cubic silver chlorobromide emulsion (bromide content: 80 mol %, average grain size: 0.35 micron) was prepared.

After washing and desalting steps, the emulsion was chemically sensitized by addition of 5 mg of sodium thiosulfate and 20 mg of 4-hydroxy-6-methyl-1,3,3a,7-tetraazaindene at a temperature of 60° C. The yield of the emulsion was 600 g.

The dye solution (I) was prepared by dissolving 160 mg of Sensitizing Dye (D-22) illustrated below in 400 ml of methanol:

D-22

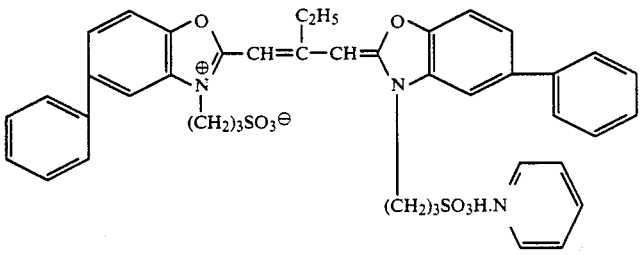

The emulsion (III) for the fifth layer was prepared as follows.

To a well-stirred aqueous gelatin solution (containing 20 g of gelatin and ammonium in 1,000 ml of water, and kept at 50° C.), 1,000 ml of an aqueous solution containing potassium iodide and potassium bromide and an aqueous silver nitrate solution (containing 1 mole of silver nitrate in 1,000 ml of water) were simultaneously added as the pAg of the resulting mixture was maintained constant. Thus, a monodisperse octahedral silver iodobromide emulsion (iodide content: 5 mol %, average grain size: 0.5 micron) was prepared.

After washing and desalting steps, the emulsion was subjected to gold and sulfur sensitizations by addition of 5 mg of chloroauric acid (tetrahydrate) and 2 mg of sodium thiosulfate. The yield of the emulsion was 1 kg.

Gelatin dispersions of dye providing substances were prepared as follows.

13 g of the yellow dye providing substance (1), 6.5 g of the high boiling solvent (1) and 6.5 g of the electron donor (ED-11) were added to 37 ml of cyclohexanone, and dissolved thereinto. The resulting solution was mixed with 100 g of a 10% gelatin solution and 60 ml of a 2.5% aqueous solution of sodium dodecylbenzenesulfonate with stirring, and dispersed thereinto using a homogenizer for 10 minutes at 10,000 r.p.m. The thus obtained dispersion was called the yellow dye providing substance dispersion.

16.8 g of the magenta dye providing substance (2), 8.4 g of the high boiling solvent (1) and 6.3 g of the electron donor (ED-11) were added to 37 ml of cyclohexanone, and dissolved thereinto. The resulting solution was mixed with 100 g of a 10% gelatin solution and 60 ml of a 2.5% aqueous solution of sodium dodecylbenzenesulfonate with stirring, and dispersed thereinto using a homogenizer for 10 minutes at 10,000 rpm. The thus obtained dispersion was called the magenta dye providing substance dispersion.

15.4 g of the cyan dye providing substance (3), 7.7 g of the high boiling solvent (1) and 6.0 g of the electron donor (ED-11) were added to 37 ml of cyclohexanone, and dissolved thereinto. The resulting solution was mixed with 100 g of a 10% gelatin solution and 60 ml of a 2.5% aqueous solution of sodium dodecylbenzenesulfonate with stirring, and more completely dispersed using a homogenizer for 10 minutes at 10,000 r.p.m. The thus obtained dispersion was called the cyan dye providing substance dispersion.

EXAMPLE 3

Dye fixing elements R-301 to R-310 were prepared in the same manner as the dye fixing elements R-101 to R-110 in Example 1, except a gelatin emulsion of silicone oil (1)* (silicone oil: 0.04 g/m$^2$, gelatin: 0.05 g/m$^2$) was used in the third layer in place of 0.04 g/m$^2$ of Teflon ®30J (1), and further the antioxidant (1) and the ultraviolet absorbent (1) were removed from the second layer.

Therein, though each coating solution for the protective layer of the dye fixing element was put in a 100μ cylinder and allowed to stand at 40° C. for one day and night, separation into upper and lower two phases or more was not caused similarly to the results of Example 1.

The exposure, heat development and transfer steps were carried out in the same manner as in Example 2 using each of the foregoing dye fixing elements R-301 to R-310 and the same light-sensitive element as employed in Example 2, and each dye fixing element was peeled apart from the light-sensitive element. Thus, clear images of blue, red and gray colors were formed in each dye fixing element corresponding to the separation filters, B, G, R and gray.

As for the surface appearance of the dye fixing elements after or before processing, in analogy with the corresponding dye fixing elements R-101 to R-110, the dye fixing elements R-301 to R-303, R-307 and R-310, in which only either the hydrophilic polymer A or the hydrophilic polymer B was used, had a glossy surface, but the dye fixing elements R-304 to R-306, R-308 and R-309, in which the microphase separation of this invention was caused in the coated layer, had a mat surface.

Silicone Oil (1)*

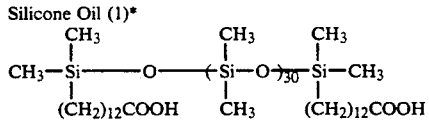

EXAMPLE 4

Dye fixing elements, R-401 to R-410 having the layer structure shown in Table 5 were prepared.

TABLE 5

| Layer No. | Layer Name | Additives | Amount Added (g/m$^2$) |
|---|---|---|---|
| 3rd | Protective | Sumikagel ® L-5H, produced | 0.25 |

TABLE 5-continued

| | | | |
|---|---|---|---|
| | layer | by Sumitomo Chemical Co., Ltd. | |
| | | Surfactant A*1 | 0.02 |
| | | Surfactant B*2 | 0.1 |
| | | Silicone oil*3 | 0.04 |
| | | Guanidinopicolinic acid | 0.4 |
| 2nd | Mordanting layer | Hydrophilic polymer A*4 | x |
| | | Hydrophilic polymer B*5 | y |
| | | Hydrophilic polymer C*6 | z |
| | | Mordant* | 2.4 |
| | | Dextran (molecular weight: 70,000) | 0.9 |
| | | Oil droplet*8 | 1.4 |
| | | Guanidinopicolinic acid | 1.5 |
| 1st | Subbing layer | Gelatin | 0.4 |
| | | Guanidionopicolinic acid | 0.4 |
| | | Hardener*9 | 0.25 |
| Support (paper support laminated with polyethylene) | | | |

*1 $C_8H_{17}SO_2N(C_3H_7)CH_2COOK$

*2 $C_{11}H_{23}CONHCH_2CH_2CH_2N^{\oplus}(CH_3)_2-CH_2COO^{\ominus}$

*3 Silicone Oil X-22, produced by Shin-Etsu Silicone Co., Ltd.

*4, *5, *6 } See Table 6.

*7 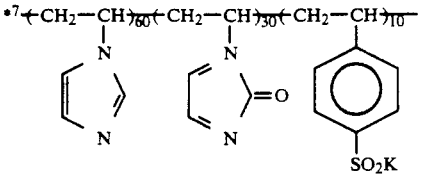

*8 Liquid paraffin

TABLE 5-continued

*9 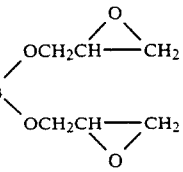

Preparation and Addition of Oil Droplet 5 ml of a 5% sodium dodecylbenzenesulfonate aqueous solution was added to 100 g of a 10% gelatin aqueous solution, and 20 g of liquid paraffin was further added thereto. The mixture was emulsified and dispersed in a homoblender at 10,000 rpm for 6 minutes to obtain a dispersion of oil droplets. This dispersion was added to the coating solution of the dye fixing layer (the third layer).

TABLE 6

| Sample No. | Hydrophilic Polymer A | x (g/m²) | Hydrophilic Polymer B | y (g/m²) | Hydrophilic Polymer B | y (g/m²) | Surface Appearance*1 |
|---|---|---|---|---|---|---|---|
| R-401 (Comparison) | Gelatin | 2.4 | — | | — | | K |
| R-402 (Comparison) | Polyvinyl alcohol | 2.4 | — | | — | | K |
| R-403 (Comparison) | Polyacryl-amide | 2.4 | — | | — | | K |
| P-404 (Invention) | Gelatin | 0.8 | Polyvinyl alcohol | 1.6 | — | | M |
| R-405 (Invention) | Gelatin | 1.2 | Polyvinyl alcohol | 1.2 | — | | M |
| R-406 (Invention) | Gelatin | 1.6 | Polyvinyl alcohol | 1.2 | — | | M |
| R-407 (Invention) | Gelatin | 1.2 | Polyacryl-amide | 1.2 | — | | M |
| R-408 (Invention) | Gelatin | 1.2 | Polyacrylic acid | 1.2 | — | | M |
| R-409 (Invention) | Gelatin | 0.8 | Polyvinyl-acrylamide | 0.8 | Polyacrylic acid | 0.8 | M |
| R-410 (Invention) | Gelatin | 0.8 | Polyvinyl alcohol | 0.4 | Polyacryl-amide | 1.2 | |

*Same as in Table 3

Images were formed using these elements in the following manner.

The color light-sensitive element having the foregoing multilayer structure as in Example 2 was subjected to a $10^{-4}$ exposure with a xenon flash lamp. Therein, the exposure was carried out through separation filters G, R and IR, which each had continuously changed density.

To the emulsion surface of the exposed light-sensitive element, 12 ml/m² of water was supplied with a bar. Thereafter, the resulting element was superimposed upon each of the foregoing dye fixing elements (image-receiving elements) R-401 to R-410 so as to come into face-to-face contact.

The superimposed elements were heated for 25 seconds with heating rollers the temperature of which was controlled so that the temperature of the water-absorbed layers might be raised up to 90° C., and then the dye fixing element was peeled apart from the light-sensitive element, resulting in the formation of yellow, magenta and cyan images in the dye fixing element corresponding to the separation filters G, R and IR.

As shown in Table 6, the surface appearance of the dye fixing elements containing high molecular binders combined in accordance with this invention was matted.

Moreover, the maximum image densities (Dmax) attained by this invention were sufficient to look at, though the measured values thereof (1.8–2.0) were lowered by about 0.2 in proportion as the surface was matted.

While the invention has been described in detail and with reference to specific embodiments thereof, it will be apparent to one skilled in the art that various changes and modifications can be made therein without departing from the spirit and scope thereof.

What is claimed is:

1. A dye fixing element comprising a support having provided thereon a dye fixing layer which mordants a diffusable dye, wherein at least one of said dye fixing layer or a layer adjacent thereto contains a combination of water-soluble polymers which exhibit phase separation from each other so as to give a matted appearance, wherein the combination of water-soluble polymers is selected from the following combinations (1) to (65):

(1) gelatin and hydroxyethyl cellulose,
(2) phthalized gelatin and polyacrylate,
(3) phthalized gelatin and polymethacrylate,
(4) phthalized gelatin and a block polymer of vinyl alcohol and acrylic acid,
(5) phthalized gelatin and polyethylene glycol (molecular weight: 20,000),
(6) phthalized gelatin and polyacrylamide,
(7) phthalized gelatin and gum arabic,
(8) phthalized gelatin and carboxymethyl cellulose,
(9) sodium or ammonium polyacrylate and polymethacrylate,
(10) sodium polyacrylate and a block polymer of vinyl alcohol and acrylic acid,
(11) sodium polyacrylate and polyethylene glycol (molecular weight: 20,000),
(12) sodium polyacrylate and polyacrylamide,
(13) sodium polyacrylate and pullulan,
(14) sodium polyacrylate and gum arabic,
(15) sodium polyacrylate and sodium alginate,
(16) sodium polyacrylate and poly(potassium vinylbenzenesulfonate),
(17) sodium polyacrylate and

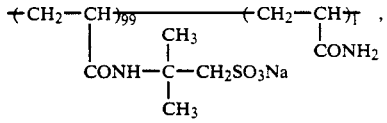

(18) sodium polyacrylate and carboxy methyl cellulose,
(19) sodium polymethylate and hydroxymethyl cellulose,
(20) sodium polymethacrylate and a copolymer of vinyl alcohol and acrylic acid,
(21) sodium polymethacrylate and polyvinyl alcohol,
(22) sodium polymethacrylate and polyethylene glycol (molecular weight: 20,000),
(23) sodium polymethacrylate and polyacrylamide,
(24) sodium polymethacrylate and pullulan,
(25) sodium polymethacrylate and gum arabic,
(26) sodium polymethacrylate and poly(potassium vinylbenzenesulfonate),
(27) sodium polymethacrylate and

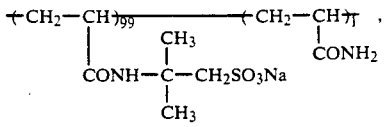

(28) sodium polymethacrylate and carboxymethyl cellulose,
(29) dextran and a block polymer of vinyl alcohol and acrylic acid,
(30) hydroxymethyl cellulose and a block polymer of vinyl alcohol and acrylic acid,
(31) hydroxyethyl cellulose and polyvinyl alcohol,
(32) hydroxyethyl cellulose and polyethylene glycol (molecular weight: 20,000),
(33) hydroxyethyl cellulose and polyacylamide,
(34) hydroxyethyl cellulose and pullulan,
(35) hydroxyethyl cellulose and dextran,
(36) hydroxyethyl cellulose and gum arabic,
(37) polyethylene glycol (molecular weight: 20,000) and polyacrylamide,
(38) polyethylene glycol (molecular weight: 20,000) and polyvinylpyrrolidone,
(39) polyethylene glycol (molecular weight: 20,000) and dextran,
(40) polyethylene glycol (molecular weight: 20,000) and gum arabic,
(41) polyethylene glycol (molecular weight: 20,000) and sodium alginate,
(42) polyethylene glycol (molecular weight: 20,000) and poly(potassium vinylbenzenesulfonate),
(43) polyvinyl alcohol and polyethylene glycol (molecular weight: 20,000),
(44) polyvinyl alcohol and polyacrylamide,
(45) polyvinylpyrrolidone and pullulan,
(46) polyvinylpyrrolidone and dextran,
(47) polyvinylpyrrolidone and carboxymethyl cellulose,
(48) sodium alginate and carboxymethyl cellulose,
(49) sodium alginate and

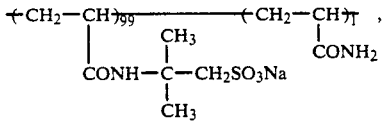

(50) poly(potassium vinylbenzenesulfonate) and

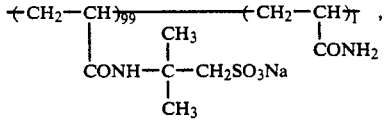

(51) methyl cellulose and hydroxyethyl cellulose,
(52) methyl cellulose and polyvinyl alcohol,
(53) methyl cellulose and polyethylene glycol (molecular weight: 20,000),
(54) methyl cellulose and polyacrylamide,
(55) methyl cellulose and pullulan,
(56) methyl cellulose and gum arabic,
(57) methyl cellulose and dextran,
(58) methyl cellulose and sodium alginate,
(59) methyl cellulose and poly(potassium vinylbenzenesulfonate),

(60) methyl cellulose and

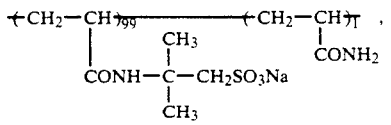

(61) poly(potassium vinylbenzenesulfonate) and carboxymethyl cellulose,

(62) methyl cellulose and carboxymethyl cellulose,

(63) polyethylene glycol (molecular weight: 20,000) and carboxymethyl cellulose,

(64) polyethylene oxide (molecular weight: 3000,000) and polyvinyl alcohol,

(65) carboxymethyl cellulose and polyvinyl alcohol.

2. An element as in claim 1, wherein at least one of said dye fixing layer or a layer adjacent thereto is prepared by coating and drying a coating solution, said coating solution comprising a solution containing said combination of water soluble polymers, said combination of polymers being substantially in a single phase condition prior to coating, and said combination of polymers separating into a two or more phase condition to give a mat appearance upon coating and drying.

3. An element as in claim 1, wherein one polymer is sodium alginate and another polymer is selected from carboxymethyl cellulose and

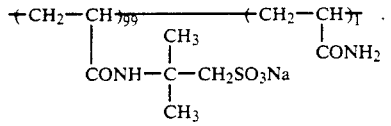

4. An element as in claim 2, wherein the viscosity of at least one of the polymers is 200 cps or less determined as a 5 wt % solution in water.

5. An element as in claim 2, wherein said drying is carried out at a temperature of −10° C. to 70° C.

6. An element as in claim 1, wherein said microphase separation structure is in the form of islets having a diameter of from 0.2 to 100 μm.

7. An element as in claim 1, wherein said microphase separation structure is in the form of islets having a diameter of from 0.5 to 50 μm.

8. An element as in claim 1, wherein said microphase separation structure is in the form of islets having a diameter of from 1 to 30 μm.

9. An element as in claim 2, wherein said coating and drying steps comprise coating at a temperature above room temperature followed by cooling to a temperature at which phase separation occurs, drying sufficiently to prevent reversion to the single phase condition when the temperature is raised, and completion of drying.

10. An element as in claim 2, wherein said coating steps comprise coating at a temperature of from room temperature to 40° C., and drying at a temperature of 60° C. or higher to accomplish drying and phase separation.

11. An element in claim 1, wherein the water-soluble polymers are incorporated in the dye fixing layer.

12. A dye fixing element as in claim 1, wherein the water-soluble polymers are incorporated in the outermost layer of the dye fixing element.

13. A dye fixing element as in claim 1, wherein the dye fixing element is capable of fixing a diffusible dye which is imagewise formed.

14. An element as in claim 1, wherein one polymer is poly(potassium vinylbenzenesulfonate) and another polymer is

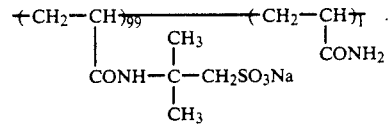

15. An element as in claim 1, wherein one of the polymers is phthalized gelatin and another of the polymers is selected from a polyacrylate, a polymethacrylate, a block polymer of vinyl alcohol and acrylic acid, polyethylene glycol with a molecular weight of 20,000, polyacrylamide, gum arabic and carboxymethyl cellulose.

16. An element as in claim 1, wherein one of the polymers is sodium polyacrylate and another of the polymers is selected from a polymethacrylate, a block polymer of vinyl alcohol and acrylic acid, polyethylene glycol with a molecular weight of 20,000, polyacrylamide, pullulan, gum arabic, sodium alginate, poly(potassium vinylbenzenesulfonate),

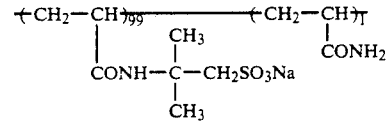

and carboxymethyl cellulose.

17. An element in claim 1, wherein one polymer is sodium polymethacrylate and another polymer is selected from hydroxymethyl cellulose, a copolymer of vinyl alcohol and acrylic acid, polyvinyl alcohol, polyethylene glycol with a molecular weight of 20,000, polyacrylamide, pullulan, gum arabic, poly(potassium vinylbenzenesulfonate),

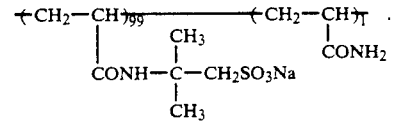

and carboxymethyl cellulose.

18. An element as in claim 1, wherein one polymer is a block copolymer of vinyl alcohol and acrylic acid and another polymer is hydroxymethyl cellulose.

19. An element as in claim 1, wherein one polymer is hydroxyethyl cellulose and another polymer is selected from polyvinyl alcohol, polyethylene glycol with a molecular weight of 20,000, polyacrylamide, pullulan, gum arabic and gelatin.

20. An element as in claim 1, wherein one polymer is polyethylene glycol with a molecular weight of 20,000 and another polymer is selected from polyacrylamide, polyvinylpyrrolidone, gum arabic, sodium alginate, poly(potassium vinylbenzenesulfonate), polyvinyl alcohol, and carboxymethyl cellulose.

21. An element as in claim 1, wherein one polymer is methyl cellulose and another polymer is selected from hydroxyethyl cellulose, polyvinyl alcohol, polyethylene glycol with a molecular weight of 20,000, polyacrylamide, pullulan, gum arabic, sodium alginate, poly(potassium vinylbenzenesulfonate), and

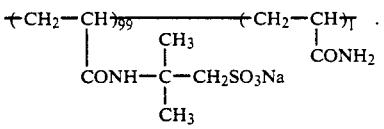

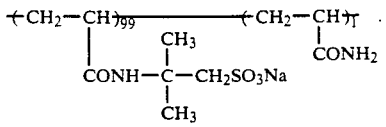

22. An element as in claim 1, wherein one polymer is polyvinyl alcohol and the other polymer is selected from polyacrylamide, polyethylene oxide and carboxymethyl cellulose.

23. An element as in claim 1, wherein one polymer is polyvinyl pyrrolidone and another polymer is selected from pullulan, and carboxyethyl cellulose.

* * * * *